US009924289B2

(12) United States Patent
Trivi et al.

(10) Patent No.: US 9,924,289 B2
(45) Date of Patent: Mar. 20, 2018

(54) SYSTEM AND METHOD FOR FORMING AND RENDERING 3D MIDI MESSAGES

(75) Inventors: Jean-Michel Trivi, Aptos, CA (US); Jean-Marc Jot, Aptos, CA (US); Thomas C Savell, Santa Cruz, CA (US); Michael Guzewicz, Campbell, CA (US)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 13/044,473

(22) Filed: Mar. 9, 2011

(65) Prior Publication Data

US 2011/0252950 A1 Oct. 20, 2011

Related U.S. Application Data

(62) Division of application No. 11/293,335, filed on Dec. 1, 2005, now Pat. No. 7,928,311.

(60) Provisional application No. 60/632,360, filed on Dec. 1, 2004.

(51) Int. Cl.

| | |
|---|---|
| ***G10H 7/00*** | (2006.01) |
| ***H04S 7/00*** | (2006.01) |
| ***G10H 1/00*** | (2006.01) |

(52) U.S. Cl.

CPC ..... *H04S 7/30* (2013.01); *G10H 1/0066* (2013.01); *H04S 2400/01* (2013.01); *H04S 2420/01* (2013.01)

(58) Field of Classification Search

USPC ..... 84/645

See application file for complete search history.

(56) References Cited

U.S. PATENT DOCUMENTS

| | | | | |
|---|---|---|---|---|
| 5,541,358 | A * | 7/1996 | Wheaton et al. | 84/645 |
| 5,977,471 | A * | 11/1999 | Rosenzweig | G10H 1/0091 381/17 |
| 6,459,797 | B1 * | 10/2002 | Ashour et al. | 381/18 |
| 6,694,033 | B1 * | 2/2004 | Rimell et al. | 381/307 |
| 7,408,108 | B2 * | 8/2008 | Ludwig | 84/719 |
| 7,864,963 | B2 * | 1/2011 | Hagiwara | 381/19 |
| 2003/0007648 | A1 * | 1/2003 | Currell | H04S 7/30 381/61 |
| 2003/0118192 | A1 * | 6/2003 | Sasaki | 381/17 |
| 2005/0135629 | A1 * | 6/2005 | Kim | H04S 5/00 381/17 |

* cited by examiner

*Primary Examiner* — Christopher Uhlir

(74) *Attorney, Agent, or Firm* — Russell Swerdon; Desmund Gean

(57) ABSTRACT

MIDI-generated audio streams or other input streams of audio events are perceptually associated with specific locations in 3D space with respect to the listener. A conventional pan parameter is redefined so that it no longer specifies the relative balance between the audio being fed to two fixed speaker locations. Instead, the new MIDI pan parameter extension specifies a virtual position of an audio stream in 3D space. Preferably, the relative position of a single audio stream is set along a predefined arc in 3D space.

20 Claims, 11 Drawing Sheets

SYSTEM AND METHOD FOR FORMING AND RENDERING 3D MIDI MESSAGES

RELATED APPLICATIONS

This application is a divisional of U.S. application Ser. No. 11/293,335, filed on Dec. 1, 2005, which claims the benefit of U.S. Provisional Application No. 60/632,360 filed on Dec. 1, 2004, the entire disclosures of which are incorporated herein by reference. This application is related to application Ser. No. 10/907,989 entitled "Method and Apparatus for Enabling a User to Amend an Audio File", filed on Apr. 22, 2005, and to U.S. Pat. No. 5,763,800, issued on Jun. 9, 1998 and entitled "Method and Apparatus for Formatting Digital Audio Data", the disclosures of which are incorporated herein by reference.

BACKGROUND OF THE INVENTION

1. Field of the Invention

The present invention relates to three-dimensional (virtualized) sound. More particularly, the present invention relates to controllers for generating and rendering three-dimensional (3D) sound messages capable of playback on a variety of instruments and synthesizers.

2. Description of the Related Art

The Musical Instrument Digital Interface (MIDI) standard has been accepted throughout the professional music community as a standard set of messages for the real-time control of musical instrument performances. MIDI has become a standard in the PC multimedia industry as well.

The General MIDI standard was an attempt to define the available instruments in a MIDI composition in such a way that composers could produce songs and have a reasonable expectation that the music would be acceptably reproduced on a variety of synthesis platforms.

When a musician presses a key on a MIDI musical instrument keyboard containing or communicating to a rendering music synthesizer, the following process is initiated. The key depression is encoded as a key number and "velocity" occurring at a particular instant in time on one of 16 MIDI channels. The MIDI channel associates the key depression with a specific MIDI musical instrument keyboard. A MIDI channel is separate and distinct from an audio channel and the two should not be confused. In addition, there are a variety of other parameters which determine the nature of the sound produced. For example, each MIDI channel may have assigned a variety of parameters in the form of MIDI "continuous controllers" that alter the sound in some manner. The final result of this process is that the rendering synthesizer produces a mono or stereo sound.

Legacy MIDI currently specifies stereo playback of an instrument by specifying a pan parameter to designate the balance or mixing between the right and left streams of the stereo signal to help position the sound source between two speakers. While legacy MIDI provides a one-dimensional control for the placement of the sound source, the legacy format is incapable of placing the sound source in a three-dimensional field.

Three-dimensional sound is defined as audio that the listener perceives as emanating from locations in their surrounding space. Three-dimensional sound has been widely used in producing and rendering compelling audio content for modern Interactive Audio systems, particularly video game audio on personal computers. Modern economical audio processors have the processing power that was once previously only available in very large systems. In response, it now has become more feasible to render such 3D content in small embedded systems, such as stand-alone synthesizers or mobile telephones. With the proliferation of multi-channel systems for home-cinema, video games and music, the need is increasing for multi-channel production systems to address these new playback configurations. Since modern Interactive Audio rendering systems have more processing power than ever before, it has become more feasible to tightly integrate the functionality of music synthesis and interactive 3D positional audio.

Recognizing the latent emphasis on three-dimensional sound, the advancement of music messaging formats from a simple stereo rendition to three-dimensional sound rendition is also desirable. For example, it would be desirable to convert a composition expressed in a standard (legacy) MIDI format capable of rendering in stereo to one capable of true three-dimensional sound rendering.

SUMMARY OF THE INVENTION

The present invention enables MIDI-generated audio streams to be perceptually associated with specific locations in 3D space with respect to the listener. A conventional MIDI pan parameter is redefined so that it no longer specifies the relative balance between the audio being fed to two fixed speaker locations. Instead, the new 3D MIDI parameter extensions specify a virtual position of an audio stream in 3D space. Preferably, the relative position of a single audio stream is set along a predefined arc in 3D space. The format specified in accordance with the invention also specifies the manner in which the arc itself is defined and controlled. Further, the distance of the arc from the listener for rendering purposes is defined.

Provided is a method for specifying the perceived 3D location of MIDI-generated audio streams such that the pre-existing MIDI control information is inobtrusively incorporated into the new specification system (the extended message system). This enables the automated upmix of legacy MIDI content to full 3D MIDI content through a simple parameter-remapping scheme.

Legacy MIDI messages may control audio streams to be rendered on left and right speakers, with the relative amplitude of each stream into the left and right speakers controlled by the MIDI pan parameter. In one embodiment, the upmix to a 3D spatialization is provided without discarding the pan information in the original legacy MIDI messages or causing aberrations in perceived location of the single composite stream implied by the original pan information when positions of virtual speakers are changed. For example, the present invention avoids the possibility of a center-panned stream flipping from being heard in front of the listener to being heard behind the listener as the two virtual speaker locations are continuously repositioned from first positions at 60 degrees right and left to second positions at 120 degrees right and left of the listener.

A system is created and designed in part to playback legacy MIDI content on a 3D instrument, synthesizer, or system. The messaging system allows the addition of new controllers to take existing content, placing it in 3D space, and manipulating it. Our 3D messaging system (3D MIDI) also allows the creation of new original content that is backwards compatible with existing MIDI playback systems.

An implementation specification is generally defined herein which contains the formulas for the combination of the new 3D MIDI controllers and the legacy MIDI Pan controller. That is, the implementation preferably uses Pan Spread as a way to upmix 2-ch MIDI content. In order to create a virtual position for the sound source, a Pan value is received and multiplied by Pan Spread. Then, we use azimuth and elevation values, followed by a rotation of the roll value in order to specify a position in space. In this embodiment, one assumption made is that the Pan signal from MIDI relates to a note along an arc from left to right. By using Pan Spread, we make the arc wider or narrower. We visualize the Pan Spread as the arc between the 2 virtual speakers, i.e., between the left reference position and the right reference position.

While no pan spread parameter is available in legacy MIDI, the message content from the existing legacy MIDI system in one embodiment is assumed to be placed in three dimensional space by using a default value for pan spread of 30 degrees, that is, defined to spread in both left and right directions 30 degrees from the normal, "on center" position. Other assigned default values preferably include azimuth (0 degrees) and elevation (0 degrees).

Further, other methods are provided to promote 2-channel MIDI content to 3D by automatically setting one or more 3D MIDI parameters according to the value of the legacy MIDI (i.e., 2D MIDI) Pan parameter. Further still, the scope of the invention includes variants where the same, i.e., the conversion from 2D to 3D, is done from other legacy MIDI parameters. That is, in addition to the use of the pan spread parameter as a way to upmix 2-ch sources, preferably extensions are provided for using additional 3D MIDI parameters for more flexible upmix effects. For example, useful upmixing is accomplished by remapping other parameters as a function of yet other conventional MIDI parameters (e.g., establishing a relationship between the key-velocity parameter and the distance parameter). The scope is intended to extend to manual or automated upmixing of conventional MIDI messages wherein relationships are established between conventional MIDI parameters and the new 3D parameters and/or novel parameter interpretations that we have defined and discussed above in 3D MIDI.

According to one aspect of this embodiment, a distance model with a fixed-point distance parameter is used to accommodate a limited number of bits available in the MIDI message format. The conventional legacy MIDI specification allows for 7 bits of precision or 14 bits of precision in the message content or values. In 3D MIDI we determine distance as a ratio of an absolute distance to best utilize the limitations of the data format. This distance, called the maximum distance, is expressed in absolute units. It is used to define the range of distances where changing the distance between the listener and the sound has an impact on the sound intensity. Because of the limited number of steps that can be used to represent such changes, encoding the distance as a ratio of the maximum distance presents the advantage of maximizing the precision of the distance encoding within its effective range. We also introduce a gain parameter, specified in millibels (mB), as an absolute way to control the volumes of the content to be spatialized.

According to another embodiment, a user interface is provided to compute the parameters that control the 3D portion of a MIDI synthesizer.

Our output is the presentation of a music message or notation system that can be received by 3D engines and converted to 3D sound. Furthermore, we provide a messaging system that can be read by the more primitive legacy (i.e., "standard" or 2D) MIDI systems and played back using features of the message compatible with the legacy MIDI system.

An automated upmix of legacy MIDI content to full 3D MIDI content is achieved in one embodiment through a simple parameter remapping scheme. A collection of MIDI notes, each with its own Pan parameter value, can be repositioned so that the notes emanate not merely from a 60-degree arc in front of the listener but from a full 360-degree circle surrounding the listener.

Embodiments of the present invention allow MIDI-generated audio streams to be perceptually associated with specific locations in 3D space with respect to the listener. By specifying separate Pan Spread parameters, the utility of the original Pan information is preserved. Hence, the original Pan information is usefully augmented to produce a more compelling listening experience.

As known to those of skill in the relevant arts, MIDI messages assume that the output of the rendering is a pair of audio streams, intended to correspond to left and right speakers, with the relative amplitude of these two streams controlled by the MIDI Pan parameter. Embodiments of the present invention provide methods for 3D spatialization of this stereo stream. According to one embodiment, the stereo stream is reduced or decimated down to a single monaural stream. Subsequently, the single composite stream is spatialized. According to an alternative embodiment, rather than specifying a single location in 3D space, the renderer is provided with two locations in 3D space, one for each of the two virtual speakers implied by the two streams.

The 3D MIDI specifications may also be incorporated within other patented MIDI synthesis schemes such as that described in U.S. Pat. No. 5,763,800, the entire specification of which is incorporated by reference as if fully set forth herein.

According to the 3D parameters described herein, the inherently speaker-centric specification of conventional MIDI is improved by the development of a listener-centric specification that retains all of the information and meaning embedded in the conventional MIDI specification while also enabling it to be usefully extended and augmented Just as the legacy MIDI Pan controller is MIDI channel-specific, i.e. each MIDI channel can have a different value for the Pan, all of the extensions described in the invention are MIDI channel-specific. For example, each MIDI channel can have different values for position and Pan Spread. Further, each note or event in a series of notes or events provided by a particular channel can be manipulated by the pan, pan spread, and other extensions described herein. While the preferred use of the embodiments described herein is as applied to MIDI signals, the scope of the invention is not so limited. The scope is intended to extend to any input stream of events describing a position in a stereo field. An event can be as simple as data or control commands for the playback of a musical note but can also include respective instructions for the playback of stored audio files. The scope is intended to extend to events as broad as included in instruction streams specifying positions for lighting effects or to the positioning of muiltimedia elements such as images, sounds, and text in multimedia streams.

In accordance with one embodiment, a method of positioning events in a 2-D or 3-D presentation space is provided. An input stream of events with at least one event having a Pan parameter that describes a position in a stereo field is received by the processing unit. An output position in the presentation space is determined from the combination of The Pan parameter with a spread parameter controlling the angular size of the stereo field. The output position is assigned to at least one event. In one variation of this embodiment, the input stream is a MIDI signal, and the at least one event is a MIDI note. In yet another variation of this embodiment, the at least one event is an audio event and the method further comprises reproducing the event so that its location is perceived as the output position in the listening space.

In accordance with another embodiment, a method of positioning events in a presentation space is provided. An input stream of events with at least one event having a Pan parameter that describes a position in a stereo field is received. At least one subdivision is defined in the stereo field. Each of the defined subdivisions is associated with a Pan interval of the range provided in the Pan parameter. An output region in the presentation space is determined from the combination of the Pan interval of the at least one stereo field subdivision with a spread parameter controlling the angular size of the stereo field. The output region in the presentation space is assigned to the at least one subdivision. In one variation of this embodiment, the input stream is a MIDI signal, and the at least one event is a MIDI note. In yet another variation of this embodiment, the at least one event is an audio event and the method further comprises reproducing the event so that its location is perceived as emanating from the output region in the listening space. In yet another aspect of this embodiment, the spread parameter is used to create a wrap-around effect of the events in the presentation space.

In accordance with yet another embodiment, a method of positioning events in a presentation space is provided. An input audio stream comprising at least one channel of audio is received, the input audio stream defining sounds positioned in a stereo field. The one or more channels of audio are processed to derive a secondary audio stream comprising three or more secondary channels of audio. At least one secondary channel of audio is assigned a position parameter that describes a position in the stereo field. An output position in the presentation space is determined from the combination of the position parameter with a spread parameter controlling the angular size of the stereo field. The output position is assigned to the at least one secondary channel. In one variation of this embodiment, the input stream is derived from a MIDI signal. In yet another variation of this embodiment, reproduction of the at least one secondary audio channel comprises generating an audio signal to feed headphones or loudspeakers. In yet another aspect of this embodiment, the spread parameter is used to create a wrap-around effect of the events in the presentation space.

In accordance with another embodiment still, a method of upmixing an input signal having audio control data is provided. An input signal having a first set of parameters identified from the control data is received. A second set of parameters is derived from the input signal audio control data. An output signal having the second set of parameters associated with it is generated. At least one of the second set of parameters in the output signal is modified as a function of at least one of the first set of parameters provided by the input signal. In one variation of this embodiment, the input signal is a MIDI signal and the first set of parameters comprises at least one of Modulation, Breath, Volume, Balance, Pan, Expression, and Pitch Bend (MIDI parameters). The output signal is a 3D MIDI signal and the second set of parameters comprises at least one of the following 3D MIDI parameters: Azimuth, Elevation, Gain, Distance Ratio, Maximum Distance, Gain At Maximum Distance, Reference Distance, Pan Spread, and Roll.

In accordance with yet another embodiment a method of positioning audio events in a presentation space is provided. The method includes receiving an input stream of events with at least one event having a Pan parameter that describes a position in a stereo field. The Pan parameter combines with rendering parameters of the presentation space to assign a secondary position in the presentation space to the event. The secondary position is combined with a spread parameter controlling a wrap-around effect in the presentation space. As a result, an output position in the presentation space is assigned to the event. In one variation of this embodiment, the spread parameter is controlled by the user on a user interface device, such as by turning a global spread control.

Yet another embodiment of the present invention provides a method of converting an input signal having audio control data into an output signal having virtual 3D virtual source location information. An input signal having an associated pan parameter for defining or describing a position in a stereo field is received. A pan spread parameter is specified either explicitly or implicitly by its default value to define the distance between the endpoint positions of a predefined arc. At least one location parameter is specified for defining the location of the predefined arc. Accordingly, the output signal is configured to represent the 3D virtual source location as a function of at least the pan parameter, the pan spread parameter, and the location parameter, either form an explicitly stated parameter value or from implicit default values.

In a further aspect, the location parameters comprise an azimuth parameter for specifying the center point of the predefined arc relative to the orientation of the listener; an elevation parameter for specifying the center point of the predefined arc relative to a horizontal plane surrounding the listener; a pan roll parameter for controlling the tilt of the predefined arc relative to a horizontal plane surrounding the listener; and a distance parameter for specifying the distance of the center point of the predefined arc from the listener.

In accordance with another embodiment, a method of generating audio data signals from an enhanced MIDI control signal is provided. The MIDI control signal is enhanced with virtual location information defining the location of a predefined arc and pan information to correspond to an input signal such as including a pair of audio streams. The method involves determining the positional information for the predefined arc; using the pan information for the streams to define a virtual source position along the predefined arc; and generating audio data signals corresponding to the virtual source position. The predefined arc is defined by a combination of at least two of the following parameters or their default values: maximum distance, gain at maximum distance, distance ratio, reference distance ratio, azimuth angle, elevation angle, pan spread, roll angle, and gain.

In yet another embodiment, a MIDI control signal is processed to provide spatialization cues to perceive a sound source corresponding to the MIDI control signal at a virtual location in three dimensional space. The position of a panning arc in the three dimensional space is initially defined. The virtual source position is defined by reinterpreting the pan control parameter associated with the MIDI control signal as a relative position along the panning arc. In one aspect of this embodiment, the audio data streams are a binaural pair filtered such that the sound is perceived as emanating from the virtual source position. In another embodiment, the audio data steams are multichannel streams configured such that when the streams are rendered on a suitable multichannel playback system, the listener perceives the sound as emanating form the virtual source position.

These and other features and advantages of the present invention are described below with reference to the drawings.

DETAILED DESCRIPTION OF PREFERRED EMBODIMENTS

Figure 1:
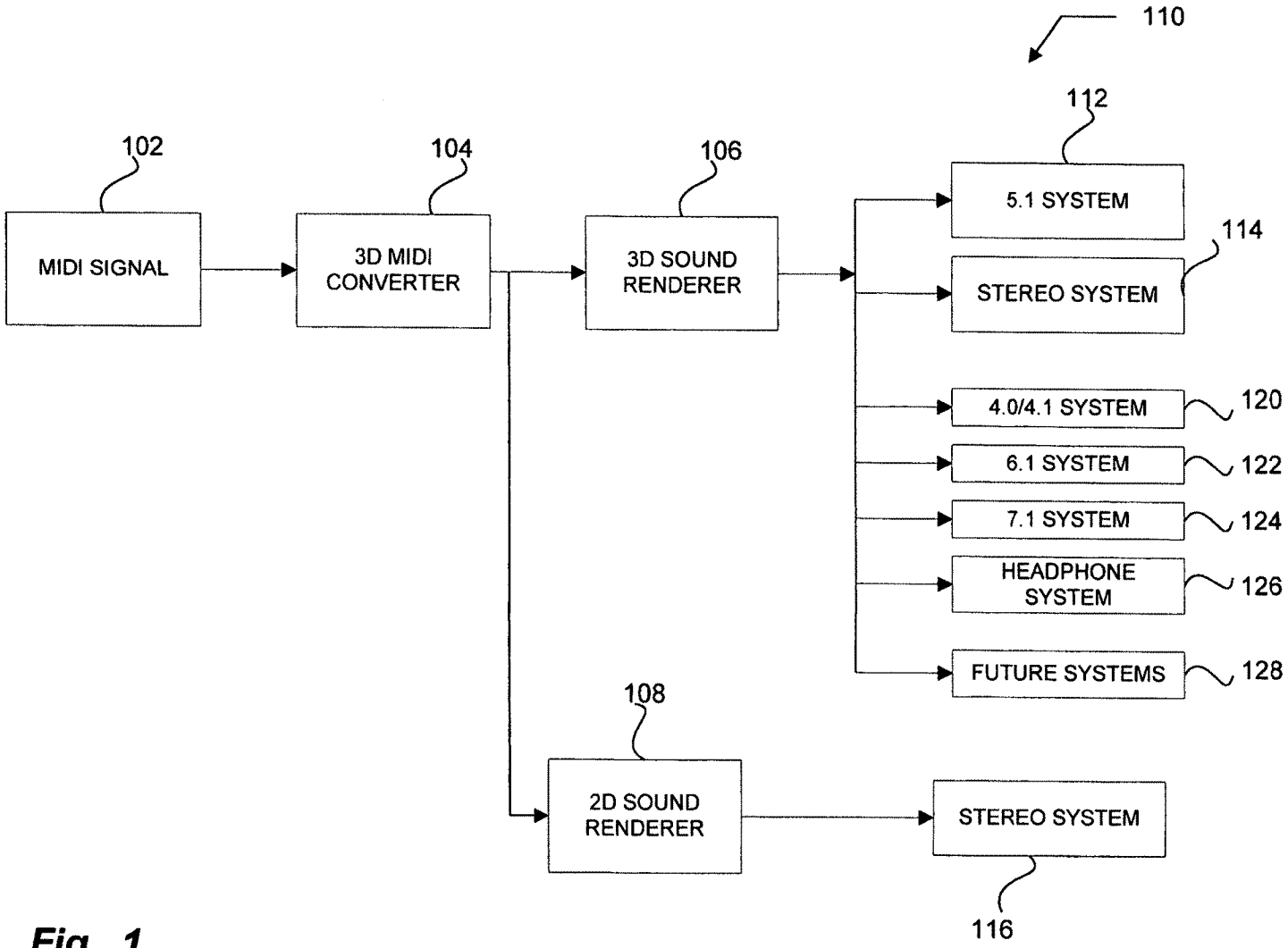
FIG. 1 is a diagram illustrating conversion of conventional or 3D MIDI signals to augmented 3D MIDI signals in accordance with one embodiment of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

Various embodiments of the present invention enable MIDI-generated audio streams to be perceptually associated with specific locations in 3D space with respect to the listener. A conventional MIDI pan parameter is redefined so that it no longer specifies the relative balance between the audio being fed to two fixed speaker locations. Instead, in one embodiment, the new MIDI pan parameter extension specifies the relative position of a single audio stream along a predefined arc in 3D space. The format specified in accordance with the invention also specifies the manner in which the arc itself is defined and controlled. Further, the distance of the arc from the listener for rendering purposes is defined.

In particular, the invention in its various embodiments provides a method for specifying the perceived 3D location of MIDI-generated audio streams such that the pre-existing MIDI control information is unobtrusively incorporated into the new specification system. This enables the automated upmix of legacy MIDI content to full 3D MIDI content through a simple parameter-remapping scheme. Legacy MIDI messages may control audio streams to be rendered on left and right speakers, with the relative amplitude of each stream into the left and right speakers controlled by the MIDI pan parameter. The upmix to a 3D spatialization is provided without discarding the pan information in the original legacy MIDI messages or causing aberrations in perceived location of the single composite stream implied by the original pan information when positions of virtual speakers are changed. For example, the present invention avoids the possibility of a center-panned stream flipping from being heard in front of the listener to being heard behind the listener as the two virtual speaker locations are continuously repositioned. For example, the repositioning may involve movement from a first set of positions 30 degrees right and left to a second set of positions at 120 degrees right and left of the listener.

That is, according to the first embodiment of the present invention, MIDI-generated audio streams are perceptually associated with specific locations in 3D space with respect to the listener. By specifying separate pan-spread parameters, the utility of the original pan information is preserved. Hence, the original pan information is usefully augmented to produce a more compelling listening experience. Without intending to be limiting, a particular application of the present invention in a MIDI messaging system is described below.

Typical standard MIDI content provides designations for only two channels. However, a variety of multi-channel speaker systems are available for playback of audio. For example, 5.1 and 7.1 systems are widely used in home theater systems.

The present invention in accordance with the first embodiment provides a listener centric description of the sound scene surrounding the individual. Preferably, through the use of the parameters specified below, a spherical polar coordinate system enables the position of the virtual source to be specified for rendering by 3D audio systems. Further, a method of increasing resolution over that offered by 7 bit controllers is provided.

Accordingly, an extended specification is provided by using at least one of the following nine parameters. These parameters include azimuth, elevation, pan spread angle, pan roll angle, maximum distance, gain at maximum distance, reference distance ratio, distance ratio, and gain.

Each parameter is set by a corresponding controller, the corresponding controller designated in the extended MIDI message system by a specified message format. Further, the system preferably enables harmonization between existing 2D pan parameters and 3D sound spatialization by providing a scalable parameter, or preferably a set of scalable parameters. That is, the extended specification may be read on both conventional 2D (i.e., legacy) rendering systems as well as 3D rendering systems, without affecting the playback.

Preferably, the audio streams are set in 3D space using a spherical polar coordinate system. That is, the distance of the sound source from the listener as well as the angular positions of the source from two reference axes are determined. More preferably, a combination of parameters are used to specify both distance and angular position. For example, in order to designate angular positioning of the sound source, a separate controller is specified for each of the azimuth angle and the elevation angle. Further, in order to apply the Pan controller from a standard legacy MIDI to a multi-channel playback configuration, an assumption is made that the Pan controller positions sounds along an arc. This arc is positioned in 3D space. To implement these features, controllers are designated for Pan Spread angle and Pan Roll angle. Finally, to determine the distance to the sound source and to accommodate distance-based attenuation, separate controllers are designated for the following four parameters: maximum distance, gain at maximum distance, reference distance ratio, distance ratio, and gain.

By integrating the above-mentioned controllers into the MIDI extended specification in embodiments of the present invention, a message system capable of positioning a sound source in three-dimensional space may be realized. Further, this message system enables manipulation of the position of the sound source using a minimal number of controllers. For example, only one controller, the azimuth angle controller, is required to move sounds around the listener. Two additional controllers are provided to move sounds in additional directions, i.e., up/down and near/far. These are the elevation angle and distance ratio controllers. Finally, 6 additional controllers are provided to refine the behavior of the MIDI channel in the 3D environment. These include the gain controller, Pan Spread and the various distance/attenuation controllers. Further details as to the formatting of each of the parameters are set forth below.

More particularly, according to a preferred embodiment, azimuth angle, elevation angle, and distance are used to describe the object, i.e., the sound source, in 3D space much like positioning techniques used in firing artillery. For example, moving an object around the head of the listener can be as easy as transmitting a single 7 bit controller, giving the application full 360 degree positioning control, without sending elevation and distance parameters. This approach, characterized as "egocentric" is therefore appropriate for describing elements evolving relative to the spectator (here the listener), which corresponds well to music authoring techniques that are often employed. This approach enables questions as to the locations of the instruments and their relative loudness at the listener's location to be addressed.

It will be appreciated by those skilled in the art, however, that it is a trivial exercise to transform the preferred coordinate system described herein into any other arbitrary coordinate system, for example, an absolute Cartesian coordinate system or a relative cylindrical coordinate system. It is also trivial to relocate the origin to anywhere in a virtual or physical space, and not necessarily located at the listener position. It therefore follows that it is trivial to transform from any other arbitrary coordinate system into the preferred coordinate system. Thus, the preferred egocentric spherical polar coordinate system is provided as one possible embodiment of the invention, and is not intended to be restrictive as to other possible embodiments. Clearly, the specific parameters controlling position must correspond to the coordinate system in use. Thus, the specific MIDI controllers must correspond to the coordinate system as well. For example, a Cartesian system would specify X, Y, and Z coordinates for position instead of azimuth, elevation, and distance.

In addition to azimuth angle, elevation angle and distance, other controllers are introduced to provide full support for the pan controller in the 3D space while still providing backwards compatibility in 2D space. The details provided as follows will describe the usage of the MIDI data bytes, and how they correspond to the 3D Sound Controlling functions.

According to one preferred aspect of the first embodiment, the controllers corresponding to the above described parameters are specified in MIDI data bytes in a manner such that suitably configured decoding equipment (e.g., 3D audio cards) can perform the designated functions, including the 3D positioning of the sound sources. Preferably, the controllers are assigned controller numbers that can be interpreted by the decoding equipment in an appropriate manner to specify the corresponding 3D functions including positioning and attenuation functions.

Music message data format systems, such as conventional MIDI, often reserve groups of bits in the data bytes for standardized functions. For example, in the conventional MIDI system, reserved controller bytes are referred to as either standard continuous controllers or registered parameter numbers (RPN's). Alternatively, designers may opt to provide controllers corresponding to non-reserved functions. For example, controllers performing the distance and/or positioning functions described herein may be given Non-registered parameter numbers (NRPN's) that are available from a pool of numbers that are freely available for designers to assign custom functions. NRPN's enable a limited number of controller numbers specifiable by the limitations of the data byte to thereby be reused in different applications (by different equipment) to perform different functions. Without intending to be limiting, the present invention preferably assigns the nine parameters for 3D positioning and playback described herein to non-registered parameter numbers.

The examples provided below will designate the controller numbers in terms of selected non-registered parameters in the MIDI music message formatting system. It is to be understood, however, that the scope of the invention is not so limited but rather intended to extend to any and all messaging systems, as well as to reserved or registered parameter numbers in those systems.

By appropriate use of the controllers, the corresponding parameters involved in allowing synthesizers to render 3D music messages may be controlled. By employing the formatting system described, authors can create compelling 3D MIDI sequences while retaining backwards compatibility with the legacy music messaging systems such as legacy MIDI.

The distance and positioning parameters are preferably configured to enable precise placement of a sound source while retaining the precision limitations of the bit format used for the conventional 2D approach. For example, in one 3D MIDI embodiment, the controllers use 14-bit precision, and each controller is designed to offer high level control using general mapping to real world units, allowing the 3D MIDI synthesizer manufacturer the freedom to offer scalable quality of their rendering.

The controllers defined herein are designed to complement the standardized controllers, not to override them. For example, in one embodiment, the 3D MIDI controllers complement existing legacy MIDI controls such as the legacy MIDI Pan controller. This arrangement permits a 3D MIDI synthesizer rendering engine, such as a 3D audio sound card, to treat all controllers independently, as they commonly do today. To accomplish this, the 3D Sound controllers are designed to work as being relative to other existing similar parameters. That is, the 3D controllers determine 3D positioning, pan, and distance values relative to parameters established by existing MIDI control data or from that configured in the sound preset data.

For example, parameters in the 3D extended set defined herein that contribute to "gain" should combine with gain values as set by standard controllers. As a further example, when used to augment conventional MIDI messages, parameters such as Master Volume and MIDI Controller #7, as well as gain parameters set in the sound preset data (if applicable), are all used to produce a final gain value. Preferably, the apparatus and techniques disclosed are designed such that they may be made to work with any synthesis model of the manufacturer's choosing. That is, it does not rely on specific synthesizer technology, such as Wavetable synthesis, or on any specific sound set, such as General MIDI, or any specific sound set data format, such as the Method and apparatus for formatting digital audio data disclosed in U.S. Pat. No. 5,763,800.

The extended music-messaging format in embodiments of the present invention preferably makes no assumptions regarding any aspect of the audio output format of the synthesizer, such as speaker layout or the output signal format. By providing the three-dimensional sound controllers that are agnostic of such details, the same standard and content can be used in any conceivable rendering system. Preferably, the rendering synthesizer accepts the 3D Sound control data, and renders the corresponding audio in the most compelling manner possible, using any speaker layout or output CODEC available or selected by the synthesizer.

FIG. 1 is a diagram illustrating the conversion to a 3D signal and the implementation of the 3D signal used in 2D and 3D synthesizers in accordance with one embodiment of the present invention. In particular, the results of up-mixing a legacy or a 3D signal are shown. A legacy or 3D MIDI signal 102 is initially provided. In order to provide signals that fully utilize the extended features of the 3D MIDI system, 3D MIDI parameters are incorporated in the incoming MIDI signal in converter 104. This may be performed automatically in appropriately configured modules or may be created with user input, for example through the use of a suitable user interface such as including those described later in this specification. For example, a user may modify the legacy MIDI signal in the conversion process to depart from the default values used in the automatic conversion process. Next, the augmented or converted 3D MIDI signal may be directed to either a 3D sound rendering system 106 or a 2D sound rendering system 108. The format of the 3D messaging system is such that the 3D sound renderer 106 will configure the received 3D MIDI signal to utilize the full capabilities of the playback system 110. That is, when played back on a 5.1 speaker system 112, the 3D signal will utilize the 5.1 configuration to allow spatialization of the signal to the virtual position determined in the conversion process to 3D MIDI. When the 3D sound renderer is used with a conventional 2 channel stereo system 114, the 3D sound renderer preferably uses the virtual position information and simulates that position over the 2 channels using appropriate filtering (e.g. head related transfer functions) to spatially locate for the listener the virtual position of the sound source. The 3D sound renderer 106 is capable of rendering the content for all current or future playback systems. For example, the content may be played back on 4.0/4.1 systems 120, 6.1 systems 122, 7.1 systems 124, headphone systems 126 and future systems 128.

Alternatively, when the converted 3D signal is transmitted from the converter module 104 to the 2D sound renderer 108, the scalable nature of the 3D signal allows the 2D sound renderer to appropriately use the pan information to adjust the balance in the two channels of the stereo system 116.

Figure 2:
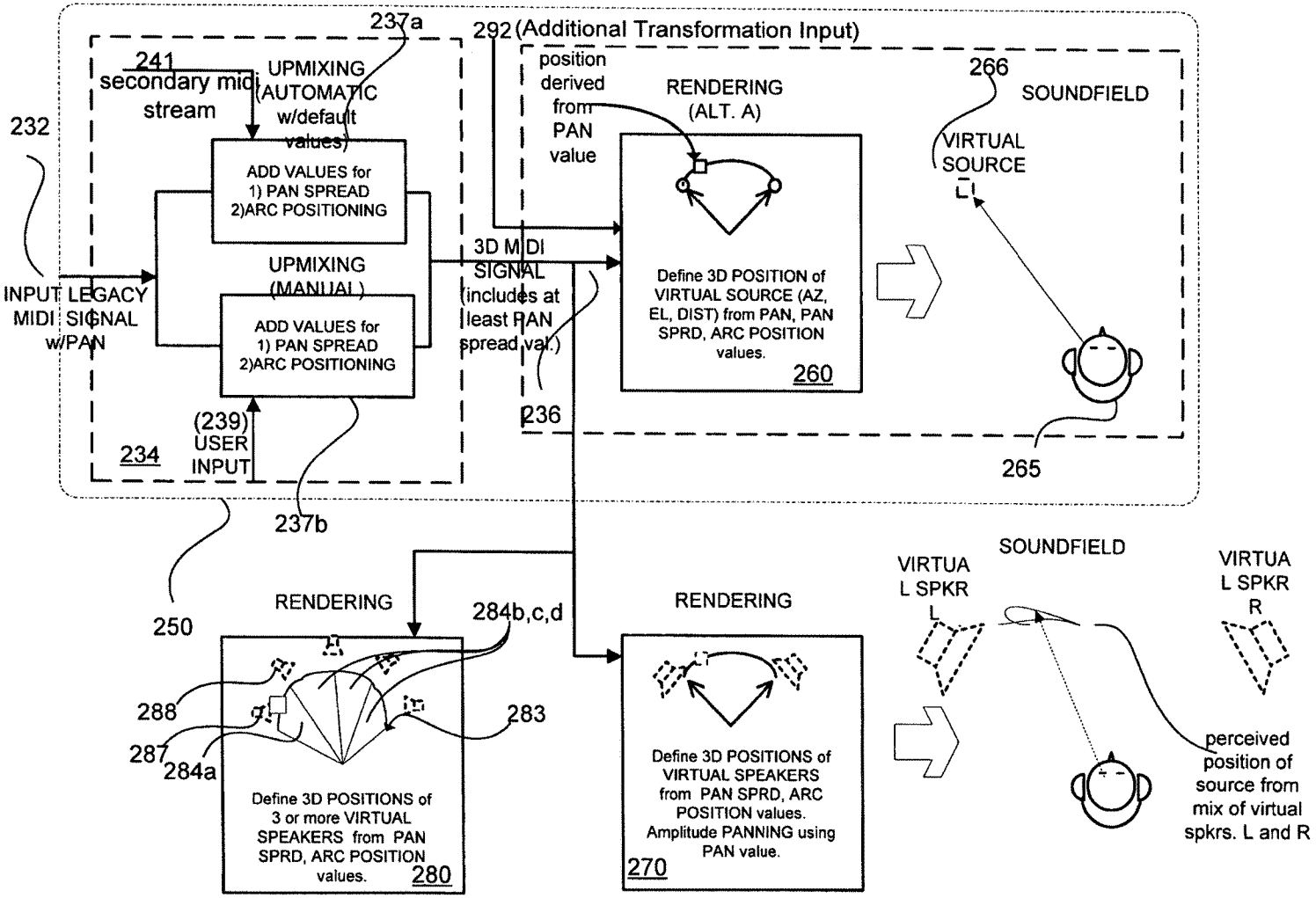
FIG. 2 is a diagram illustrating upmixing and rendering of a signal in accordance with one embodiment of the present invention.

FIG. 2 is a diagram illustrating upmixing and rendering of a MIDI signal in accordance with embodiments of the present invention. An input stream of events 232 (such as a legacy MIDI or 3D enhanced MIDI signal) is provided to a processing device 234 configured to perform upmixing. The processing device 234 may be any suitable microprocessor, programmable logic circuit, general purpose computer, or any combination of hardware or software or the like configured to perform the operations described herein. The input stream 232 preferably describes audio information and, more preferably, is a legacy MIDI signal having pan information or a 3D MIDI signal having PAN information as well as at least some of the additional spatializing parameters (extensions) to be described herein. While MIDI control signals are well known, the scope of the invention is not so limited. That is, the scope is intended to extend to any form of input stream, not necessarily limited to those describing audio information. Hence, the input stream can include less well known formats that in any way include metadata for describing or positioning an event in a presentation space or that provide a balance between 2 or more streams in the presentation space.

The input stream 232 can include a plurality of events with one or more of the plurality having a Pan parameter that describes a position in a stereo field. With legacy MIDI signals, the Pan parameter is typically interpreted as defining a balance or a measure of the relative amplitudes of the stereo signals. The processor 234 preferably is adapted to redefine the angular size of the stereo field. For example, as later shown in FIG. 3B, the angular size of the stereo field may be determined as a function of the pan spread angle. In one embodiment this is achieved by generating a Pan spread parameter and combining it with the Pan parameter. Additionally, metadata is preferably provided to position the stereo field in the presentation space. Preferably, for positioning the sound source in the presentation space, the stereo field is represented by an arc. Metadata is provided, either automatically (by using predetermined default values) or through user input 239, to define the arc position in the 3D space. Through the combination of these parameters, at least some of which are derived from the MIDI signal metadata, the output 3D MIDI signal 236 has associated with it metadata sufficient to describe fully an output position in the 3 dimensional presentation space to associate with that event. This positional information can then be used in the reproduction of the audio event. Preferably, the output signal 236 is a transitional signal that is agnostic to the format of the rendering device. That is, the output position assigned to the event can be derived from the metadata for the signal 236 and processed in a suitable manner by the rendering or reproduction device 260 so that the event (e.g., reproduction of the audio event) is perceived by the listener 265 as emanating from the virtual source position 266. For example, in rendering device 260, the 3D position of the virtual source is determined in one embodiment by treating the Pan parameter of a MIDI signal as an azimuth along a defined panning arc.

As known to those of skill in the relevant arts, filtering to simulate HRTF's (head related transfer functions) may be applied to the signal so that the sound appears to emanate from a virtual source position corresponding to the output position assigned to the event. Of course, the output position information in signal 236 could also be interpreted by a multichannel sound reproduction unit such as a 5.1 system to create the perception of the sound coming from the virtual source position 266 through the appropriate mixing of the discrete channels of the multichannel system. These details are known to those of skill in the relevant arts and hence complete details as to simulating a virtual source position in multichannel systems will not be described here.

Alternative rendering systems 270 and 280 are also shown in FIG. 2. Rendering system 270 serves to define the 3D positions of virtual speakers from the output position assigned to the event, the virtual speakers determined from the pan parameter and the spread parameter. The panning arc is defined in one aspect, the ends of the panning arc coinciding with the width of the defined stereo field. The virtual speaker locations then are set to coincide with the extremities of the panning arc. Positions between the virtual speakers may be simulated by amplitude controls on the streams fed to the respective virtual speakers, for example by methods known in the relevant art.

Rendering system 280 shows yet another alternative rendering embodiment. In this embodiment, at least one subdivision and preferably 2 or more subdivisions are defined for the stereo field. As shown in the stereo field 283, the Pan parameter is used to describe the full span of the stereo field. For each of the 4 subdivisions 284 of the stereo field 283, a Pan interval of the Pan parameter range is associated. For example, for a Pan value of 10 (on a scale of 0-127 Pan values, such as in a legacy MIDI system), the associated subdivision would be subdivision 284*a*. Accordingly, for that event, the output region in the presentation space would be assigned to that subdivision of the stereo field 283. Hence, virtual speakers 287, 288 would be designated to simulate the position of the event. Methods of creating virtual speakers for positioning in a 3D sound field are known to those of skill in the relevant arts and hence further details will not be provided here. In a further refinement, the Pan parameter can be used to define a relative position in the stereo field subdivision using panning techniques between the 2 virtual speakers bracketing that stereo field subdivision.

The spread parameter can in particular be used to affect a wrap around effect of the events in the presentation space. For example, automatic upmixing may be performed to assign a predetermined value to the angular width of the stereo field, The spread parameter can be further used to modify the wrap-around effect, i.e., to widen or narrow the angular width of the stereo field. This wrap around effect may be controlled from a user input 239, such as by using a user interface as illustrated and described with respect to FIGS. 8 and 9.

The input signal 232 may be upmixed automatically 237*a* (by using default parameters) or manually 237*b* by providing values for pan spread and the positioning of the panning arc or stereo field, such as through a user interface as later described. Further, the output signal 236 may be modified to include a second set of parameters associated with it, the second set derived from or as a function of a first set associated with the input signal 232. Further, the second set of parameters associated with the output signal 236 may be determined from parameters included in a second input signal, such as a secondary MIDI stream 241.

The output signal 236 may also be subjected to an additional transformation. For example, the rendering system 260 may be adapted to accept a signal 236 generated by the processing unit 234 or from any source. This signal 236, having associated position information, may be treated by the rendering device or system 260 to assign to the event a "secondary" position in the presentation space. This secondary position may be modified through the application, for example, of a global spread parameter 292 to modify the assigned position. That is, the final output position is computed by combining the secondary position (i.e., a transitional position) with a spread parameter, for example by a user turning a knob or moving a slider on a user interface.

As known to those of skill in the relevant arts, the MIDI specification includes a number of parameters or controllers that control sound effects for the MIDI signal. More specifically, these controllers can be used to modify sounds or other parameters of music performance in real time via MIDI connections These include, but are not limited to, Modulation, Breath, Volume, Balance, Pan, Expression, and Pitch Bend. Any or all of these parameters may be used to determine additional parameters in a 3D MIDI signal, i.e., 3D MIDI controllers useful for the positioning of a sound source in 3-dimensional presentation space. These second parameters in the output MIDI signal can comprise any or all of the 3D or legacy MIDI parameters described elsewhere in the specification including but not limited to Azimuth, Elevation, Gain, Distance Ratio, Maximum Distance, Gain At Maximum Distance, Reference Distance, Pan Spread, and Roll.

3D Sound Controller Definition and Parameter Format

The following description provides examples of parameter formats used to define a 3D sound controller compatible with existing legacy MIDI music message formats. These are intended to be illustrative and not limiting to the scope of potential applications of embodiments of the present invention.

MIDI messages or commands consist typically of a status byte and several 8-bit data bytes. There are many different MIDI messages, each corresponding to a specific musical action.

The first byte of the message is the status byte, typically detected by the hardware as the only byte having bit #7 set. The high nibble corresponds to the type of MIDI message and the low nibble n corresponds to one of 16 available MIDI channels. A message whereby the high nibble contains the value hexadecimal B (bits #7, 5 and 4 set) designates the message as a standard MIDI Continuous Controller. A MIDI Continuous Controller is any switch, slider, knob, etc. that implements a function other than the starting or stopping of notes.

In the event that the message is a Continuous Controller message, the second byte of the message is the first controller data byte, which designates the type of controller that is being used. The data byte value represented by the value $99_{10}$ (0x63) (The latter designation as used throughout this specification refers to a hexadecimal value for the number) is conventionally defined as a special kind of controller called a Non Registered Parameter Number (NRPN).

In the event that the message is a NRPN, the third byte of the message indicates the Most Significant Byte (MSB) of the type of Non Registered Parameter Controller that is being used.

An NRPN MSB for all controllers described herein is assigned, for example, the value $61_{10}$ (0x3D). (The latter designation as used throughout this specification refers to a hexadecimal value for the number.) Conversely, a "3D Sound Controller" is hereby defined as a Non-Registered Parameter Number controller whose MSB is the value 61 (0x3D).

Hence, for a non-limiting example, a 3-byte preamble defining a 3D Sound Controller in a MIDI message may take the following format:

B<n> 63 3D

Where B designates the byte as a status byte for a Continuous Controller, <n> corresponds to the MIDI Channel, "63" designates that the controllers that follow are non-registered parameters, and "3D" designates that the NRPNs are 3D sound controllers.

Following the preamble defining a 3D Sound Controller, the specific types of 3D sound controller parameters are defined by the Non Registered Parameter Number LSB Contribution.

The Non Registered Parameter Number LSB Contribution is sent in a similar manner as described above for the MSB Contribution, except that the first data byte for the LSB contribution is designated by the value $98_{10}$ (0x62), rather then $99_{10}$ (0x63), and the second data byte indicates what kind of a 3D Sound Controller is to be used.

Hence, for a non-limiting example, a 3-byte preamble defining a type of 3D Sound Controller in a MIDI message may take the following format:

B<n> 62 <Param>

Where B designates the byte as a status byte for a Continuous Controller, <n> corresponds to the MIDI Channel, "62" designates that the controllers that follow are non-registered parameters, and <Param> defines a type of 3D sound controller.

Thus, using the data byte format available for the existing music message system, e.g., conventional MIDI messages, 128 types of 3D controllers are available for definition in the least significant byte "LSB"). Thus, 128 3D Sound Controllers are available and are either predefined, such as for the nine controllers described herein, or reserved for additional 3D Sound Controllers that may be defined in the future.

More particularly, the coarse adjustment byte for the controller designates 3D sound controllers and the fine adjustment byte determines which of the 3D sound controller parameters will be called into play to respond to the data bytes.

Following the preamble defining a type of 3D Sound Controller, the data value of that type of 3D Sound Controller parameters are set by the Data Entry MSB and LSB Contributions.

The Data Entry MSB Contribution for the type of 3D Sound Controller is a Continuous Controller message, sent in a similar manner as described above for the NRPN MSB and LSB Contributions, except that the first data byte for the Continuous Controller LSB contribution is designated by the value $06_{10}$ (0x06), and the second data byte indicates the MSB contribution of the data value of the given type of 3D Sound Controller.

Hence, for a non-limiting example, a 3-byte preamble setting the MSB data contribution associated with a type of 3D Sound Controller in a MIDI message may take the following format:

B<n> 06 <Data MSB>

Where B designates the byte as a status byte for a Continuous Controller, <n> corresponds to the MIDI Channel, "06" designates that the controllers that follow are non-registered parameters, and <Data MSB> defines a type of 3D sound controller.

The Data Entry LSB Contribution for the type of 3D Sound Controller is a Continuous Controller message, sent in a similar manner as described above for the NRPN MSB and LSB Contributions, except that the first data byte for the Continuous Controller LSB contribution is designated by the value $38_{10}$ (0x26), and the second data byte indicates the LSB contribution of the data value of that type of 3D Sound Controller.

Hence, for a non-limiting example, a 3-byte preamble setting the MSB data contribution associated with a type of 3D Sound Controller in a MIDI message may take the following format:

B<n> 26 <Data LSB>

Where B designates the byte as a status byte for a Continuous Controller, <n> corresponds to the MIDI Channel, "26" designates that the controllers that follow are non-registered parameters, and <Data LSB> defines a type of 3D sound controller.

Thus, using the data byte format available for the existing music message system, e.g., conventional MIDI messages, each of the 128 types of 3D controllers are available for definition in the least significant byte "LSB") may be set to one of 16,384 data values. It will be shown that for each controller, these values will map to units that are logical for the given controller. The sections following describe the details of that mapping.

Thus, a complete 3D Sound Controller Message may take the following format:

B<n> 63 3D [B<n>] 62 <Param> [B<n>] 26 <Data LSB> [B<n>] 06 <Data MSB>

In each controller, the transmission of the second, third and fourth instances of [B<n>] are optional, but must be expected by the rendering synthesizer in accordance with existing legacy MIDI message formats. Since they are optional, these entries may or may not be shown in subsequent sections.

General 3D Sound Controller Parameter Format

The General Parameter Format for all of the potential 128 3D Sound Controllers and their associated data values is as follows.

B<n> 62 <Param> [26 <Data LSB>] 06 <Data MSB> where <n> defines the MIDI Channel, <Param> defines the 3D Sound Parameter, "26" designates that the data byte that follows is the optional 3D Sound Parameter Value LSB contribution, <Data LSB> refers to the optional 3D Sound Parameter Value LSB Contribution, "06" designates that the data byte that follows is the 3D Sound Parameter Value MSB contribution, and <Data MSB> refers to the 3D Sound Parameter Value MSB Contribution.

In each controller, the Data LSB contribution is optional. However, if the LSB is to be offered in accordance with this embodiment, its data must be sent before the MSB contribution. Preferably, the 3D MIDI Synthesizer (i.e., the 3D sound renderer) takes the MSB contribution as the only controller that has a real-time influence on the sound. Once the MSB contribution is received, the Synthesizer combines the MSB value with the previously stored LSB contribution for the given parameter, and applies that to the synthesis model.

Parameter Descriptions are offered in the following format:

| <MSB/LSB> Data Significance: | | |
|---|---|---|
| Type | MIDI value | RW Value |
| Min | <00/00> | {s} {value} {unit} |
| Max | <7F/7F> | {s} {value} {unit} |
| Step | <00/01> | {s} {value} {unit} |
| Default | <VV/vv> | {s} {value} {unit} |
| Except | <XX/xx> | {s} {value} {unit} |

<MSB/LSB> represents the Data Entry MSB and LSB respectively,
{value} will represent a real world value
{unit} will represent the real world unit to which that value applies.
{s} is one of the following:
Positive Value is positive
– Negative Value is negative
~ Approximate Value listed is approximate Preferably, the parameter description data will provide parameter descriptions that have the designated resolution and units for the non-registered parameter number (NRPN). In particular, 'Min' will represent the value of the minimum NRPN value, which is typically <00/00>. 'Max' will represent the value of the maximum NRPN value, which is typically <7F/7F>. Step will represent the value of each individual NRPN value step, which is typically <00/01>. Hence, any of 16,384 values may be represented in the two bytes. In order to allow backwards compatibility with existing messaging systems, default values are assigned to the new controllers. For example, 'Default' will represent both the MIDI value and the real world value that should be applied to the synthesizer in the Reset All Controller or Power On conditions. Preferably, different 3D controllers will be assigned different MIDI values in these conditions, and hence they are shown here as <VV/vv>. That is, the values of VV and vv will be specified with each controller.

According to a preferred embodiment, 'Except' will represent a particular MIDI value or range of values that exhibit "exceptional" behavior. Again, different 3D controllers will be assigned different MIDI values in these conditions, and hence they are shown here as <XX/xx>. That is, the values of XX and xx, as well as the behavior of the exception itself, will be specified with each controller.

As described generally above, two parameter controllers are particularly important in the positioning of the sound source in 3D space. These two controllers, pan_spread_angle and roll_angle, enable mapping of a two dimensional pan controller into 3 dimensional space. In particular, they map the existing pan controller in legacy MIDI (#10) to 3D space. Panning is made along an arc. The center of the arc is defined by the azimuth_angle and elevation_angle controllers. The angle subtended by this arc is twice the pan_spread_angle (see FIGS. 3B-3C below). Since this latter is in the following range [−180, 180], the panning arc can range from a single point in space to a full circle. Further, the arc can be rotated through control of the roll_angle controller. That is, the rotation is made around the vector having the listening point as the origin and ending in center of the arc.

Figure 5A:
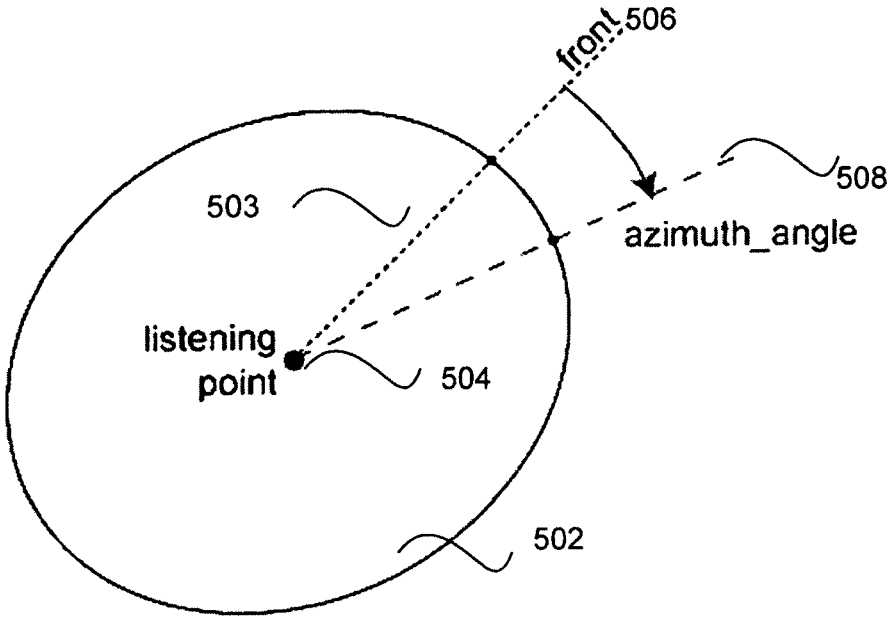
FIG. 5 is a diagram illustrating the application of 3D MIDI parameters to a virtual position in 3D space in accordance with one embodiment of the present invention.
Figure 5B:
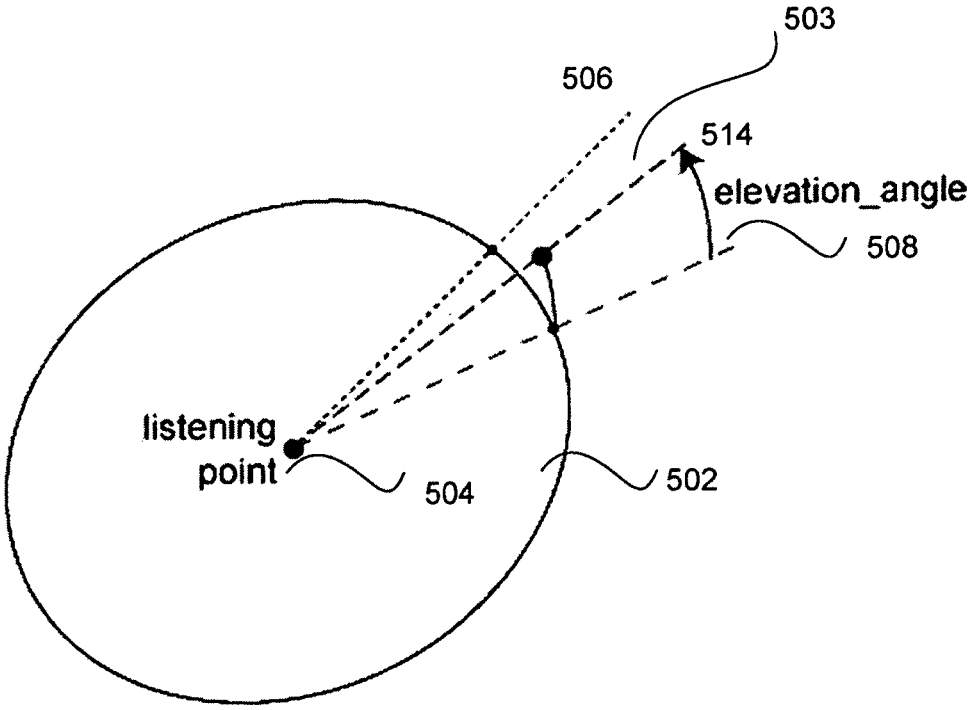
Figure 5C:
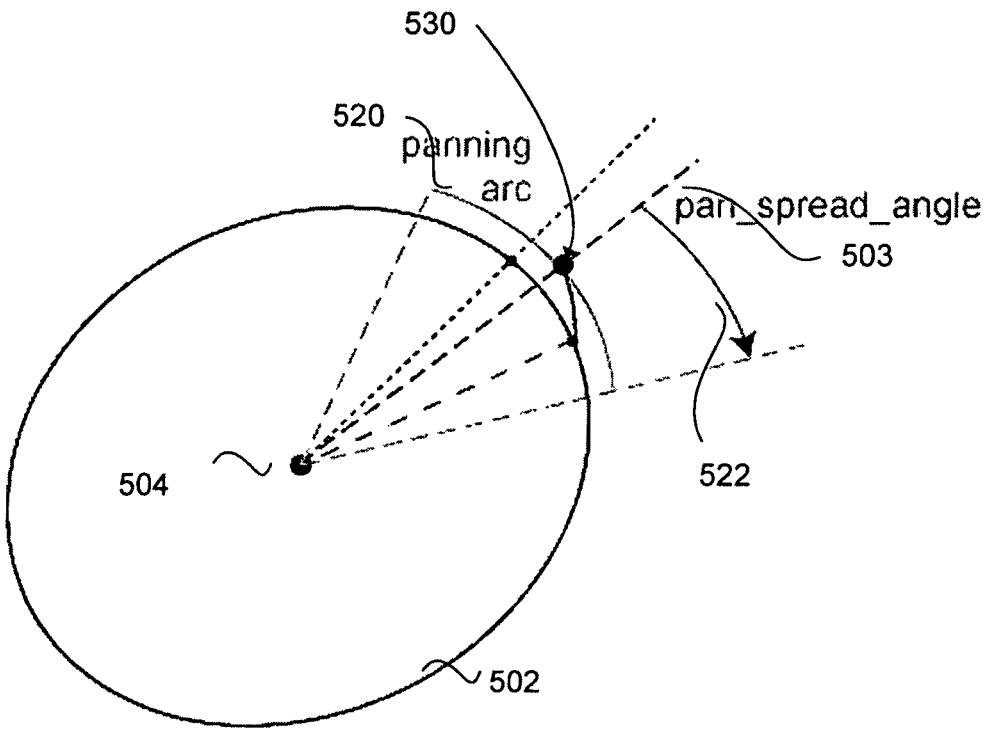
Figure 5D:
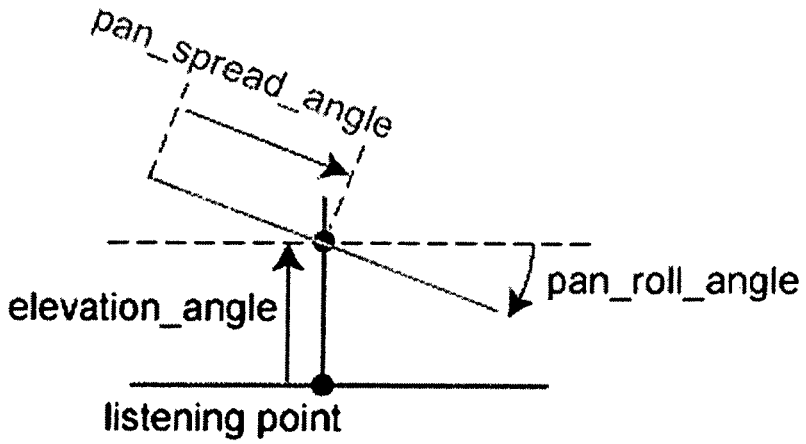

FIG. 5A-5D are diagrams illustrating use of the azimuth angle, elevation angle, pan spread angle, and roll angle parameters to map the MIDI pan controller values into 3D space, in accordance with one embodiment of the present invention. As illustrated in FIG. 5A, the azimuth angle parameter enables positioning of the vector 503 from an initial front position 506 to a new rotated position 508, the rotation occurring about a horizontal plane 502. Further, as illustrated in FIG. 5B, the elevation angle parameter is used to move the vector 503 from position 508 in the horizontal plane 502 to a new rotated position 514 in a direction orthogonal to plane 502. In each case the origin of the vector 503 is the listening point 504.

As discussed above, panning is made along an arc with the center 530 defined by the azimuth_angle and elevation_angle controllers. The panning arc 520 subtends an angle that is twice the pan spread angle 522.

3D MIDI Controllers

This section describes each 3D MIDI controller in terms of its MIDI byte format, default values, and allowable ranges and step values.

Azimuth Angle Parameter Controller

Registered Parameter Number LSB Data Value 0 would be used to control Azimuth Angle.

| B<n> 62 00 [26 <Data LSB>] 06 <Data MSB> <MSB/LSB> Data Significance: | | |
|---|---|---|
| Type | MIDI value | RW Value |
| Min | <00/00> | −180.00 degrees |
| Max | <7F/7F> | ~179.98 degrees |
| Step | <00/01> | ~0.02 degrees |
| Default | <40/00> | 0.00 degrees |

<n> MIDI Channel
<Data LSB> Azimuth Value LSB Contribution
<Data MSB> Azimuth Value MSB Contribution The azimuth is given in the horizontal plane. The default value of 0 is in front of the listening position, 90 degrees is on the right, −90 degrees on the left, and −180 degrees behind the listening position.

Elevation Angle Parameter Controller

Registered Parameter Number LSB Data Value 1 would be used to control Elevation Angle.

| B<n> 62 01 [26 <Data LSB>] 06 <Data MSB> <MSB/LSB> Data Significance: | | |
|---|---|---|
| Type | MIDI value | RW Value |
| Min | <00/00> | −180.00 degrees |
| Max | <7F/7F> | ~179.98 degrees |
| Step | <00/01> | ~0.02 degrees |
| Default | <40/00> | 0.00 degrees |

Figure 3A:
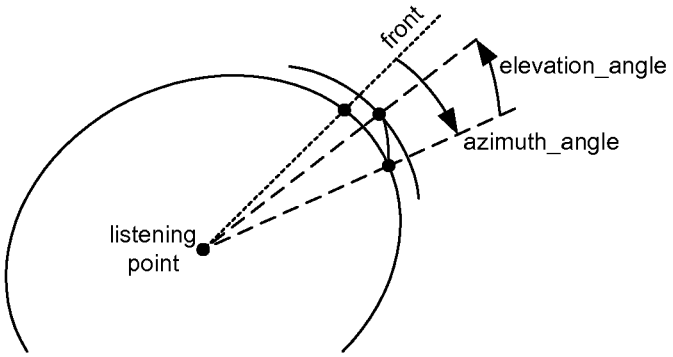
FIGS. 3A-3C are diagrams illustrating conversion of conventional MIDI signals to 3D signals in accordance with one embodiment of the present invention.
Figure 3B:
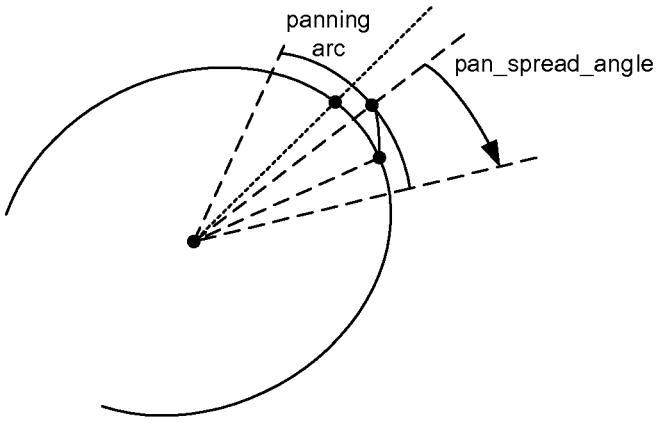
Figure 3C:
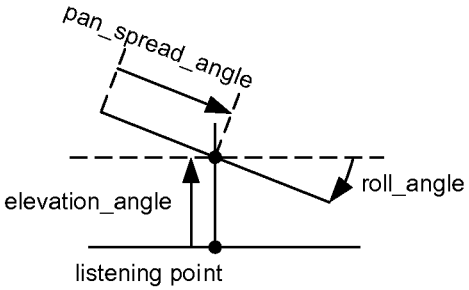

<n> MIDI Channel
<Data LSB> Elevation Value LSB Contribution
<Data MSB> Elevation Value MSB Contribution The elevation is given in the vertical plane containing the apparent position of the source (see discussion above, FIG. 3). The default value of 0 places the sound in the horizontal plane. An elevation of 90 degrees is above the listening position, −90 degrees is under it. Elevation values are preferably coded in [−180, 180[ (as opposed to [−90, 90]) in order to facilitate fly-by type trajectories, such as front-to-back and back-to-front movements don't require an azimuth change. Also this choice allows handling the MIDI bytes for elevation angle in the same manner as the azimuth angle.

Gain Parameter Controller

Registered Parameter Number LSB Data Value 2 would be used to control Gain.

B<n> 62 02 [26 <Data LSB>] 06 <Data MSB>
<MSB/LSB> Data Significance:

| Type | MIDI value | RW Value |
|---|---|---|
| Min | <00/01> | −163.82 dB |
| Max | <7F/7F> | 0.00 dB |
| Step | <00/01> | 0.01 dB (1 mB) |
| Default | <7F/7F> | 0.00 dB |
| Except | <00/00> | −∞ dB |

<n> MIDI Channel
<Data LSB> Gain Value LSB Contribution
<Data MSB> Gain Value MSB Contribution The gain parameter control offers the MIDI content author a way to control gain using mB, as an alternative to the standard MIDI CC #7/11, which offers gain through a mapping curve. This parameter proves to be convenient for computational engines that are biased toward values in real world units.

Note it is preferred that Maximum be exactly 0 dB.

Distance Ratio Parameter Controller

Registered Parameter Number LSB Data Value 3 would be used to control Distance Ratio.

B<n> 62 03 [26 <Data LSB>] 06 <Data MSB>
<MSB/LSB> Data Significance:

| Type | MIDI value | RW Value |
|---|---|---|
| Min | <00/00> | 0.00 |
| Max | <7F/7F> | 1.00 |
| Step | <00/01> | ~0.000061 |
| Default | <00/10> | 0.001 |

<n> MIDI Channel
<Data LSB> Distance Ratio Value LSB Contribution
<Data MSB> Distance Ratio Value MSB Contribution This parameter controls the ratio of the current distance that an object is away from the listener to the maximum distance (see next controller description) that an object may be away from the listener.

Note this parameter can also be interpreted as a distance of up to one kilometer, expressed in steps of 6.1 centimeters, if all other distance based attenuation parameters are kept at their default (reset-all-controller) value.

See Technical Note 2 later in the Specification for more details on this controller.

Maximum Distance Parameter Controller

Registered Parameter Number LSB Data Value 4 would be used to control Maximum Distance.

B<n> 62 04 [26 <Data LSB>] 06 <Data MSB>
<MSB/LSB> Data Significance:

| Type | MIDI value | RW Value |
|---|---|---|
| Min | <00/00> | 0.00 distance units |
| Max | <7F/7F> | 1000.00 distance units |
| Step | <00/01> | ~0.06 distance units |
| Default | <7F/7F> | 1000.00 distance units |

<n> MIDI Channel
<Data LSB> Maximum Distance Value LSB Contribution
<Data MSB> Maximum Distance Value MSB Contribution This parameter controls the maximum distance that an object may be away from the listener. See Technical Note 2 at the end of this document for more details on this controller, and on the distance model in general.

Gain at Maximum Distance Parameter Controller

Registered Parameter Number LSB Data Value 5 would be used to control Gain at Maximum Distance.

B<n> 62 05 [26 <Data LSB>] 06 <Data MSB>
<MSB/LSB> Data Significance:

| Type | MIDI value | RW Value |
|---|---|---|
| Min | <00/00> | −163.83 dB |
| Max | <7F/7F> | 0.00 dB |
| Step | <00/01> | 0.01 dB |
| Default | <51/0E> | −60.00 dB |

<n> MIDI Channel
<Data LSB> Gain at Max Distance Value LSB Contribution
<Data MSB> Gain at Max Distance Value MSB Contribution This parameter controls the gain at the maximum distance that an object may be away from the listener. See Technical Note 2 at the end of this document for more details on this controller, and on the distance model in general.

Note it is preferred that Maximum be exactly 0 db.

Reference Distance Ratio Parameter Controller

Registered Parameter Number LSB Data Value 6 would be used to control Reference Distance Ratio.

B<n> 62 06 [26 <Data LSB>] 06 <Data MSB>
<MSB/LSB> Data Significance:

| Type | MIDI value | RW Value |
|---|---|---|
| Min | <00/00> | ~−0.000061 |
| Max | <7F/7F> | 1.0 |
| Step | <00/01> | ~0.000061 |
| Default | <00/10> | 0.001 |

<n> MIDI Channel
<Data LSB> Reference Distance Ratio LSB Contribution
<Data MSB> Reference Distance Ratio LSB Contribution This parameter controls the ratio of the distance below which no distance-based attenuation is applied to the maximum possible distance that an object may be away from the listener (as set by the maximum_distance controller).

See Technical Note 2 later in this Specification for more details on this controller.

Pan Spread Angle Parameter Controller

Registered Parameter Number LSB Data Value 7 would be used to control Pan Spread Angle.

B<n> 62 07 [26 <Data LSB>] 06 <Data MSB>
<MSB/LSB> Data Significance:

| Type | MIDI value | RW Value |
|---|---|---|
| Min | <00/00> | −180.00 degrees |
| Max | <7F/7F> | ~179.98 degrees |
| Step | <00/01> | ~0.02 degrees |
| Default | <4A/55> | 30.00 degrees |

<n> MIDI Channel
<Data LSB> Pan Spread Value LSB Contribution
<Data MSB> Pan Spread Value MSB Contribution The pan spread angle is half the angle of the arc along which the pan MIDI controller is mapped to 3D space. See Technical Note 1 at the end of this document for more details on this controller.

Roll Angle Parameter Controller

Registered Parameter Number LSB Data Value 8 would be used to control Roll Angle.

| B<n> 62 08 [26 <Data LSB>] 06 <Data MSB> <MSB/LSB> Data Significance: | | |
|---|---|---|
| Type | MIDI value | RW Value |
| Min | <00/00> | −180.00 degrees |
| Max | <7F/7F> | ~179.98 degrees |
| Step | <00/01> | ~0.02 degrees |
| Default | <40/00> | 0.00 degrees |

<n> MIDI Channel
<Data LSB> Roll Value LSB Contribution
<Data MSB> Roll Value MSB Contribution The roll angle is the rotation angle of the arc along which the pan MIDI controller is mapped to 3D space. See Technical Note 1 at the end of this document for more details on this controller.

Technical Notes:

The technical notes section will elaborate on proper usage of some of the 3D Sound Controllers defined above.

Mapping the MIDI Pan Controller (#10) to 3D Space:

The two controllers pan_spread_angle and roll_angle are introduced in this specification to map the existing pan controller (#10) to 3D space. Panning is made along an arc defined by the following properties:

- the center of the arc is defined by the azimuth_angle and elevation_angle controllers (see FIG. 3C and FIG. 5D below)
- the angle subtended by this arc is twice the pan_spread_angle (see FIGS. 3B-3C and FIGS. 5C and 5D.). Since this latter is within [−180, 180[, the panning arc can range from a single point in space to a full circle.
- The arc can be rotated through the roll_angle controller. The rotation is made around the vector going from the listening point (the origin) to the center of the arc (see lower diagram below, showing the panning arc as seen from the listening point, looking at an azimuth of azimuth_angle).

With these parameters, the pan value is then used to compute a position for the sound along the arc by a simple linear interpolation on the angle covered by the arc. The default values of 30 and 0 respectively for the pan_spread_angle and roll_angle, when azimuth and elevation are at their default values (0 degrees), will simulate in 3D the normal MIDI mode of operation of the pan controller: the panning is applied between two positions (azimuth −30 and 30) that correspond to the recommended front speaker layout commonly used in the industry.

Here are a few examples showing some combinations of pan spread and roll angles:

a) pan_spread_angle=30, roll_angle=0: default situation, panning in the horizontal plane along an arc of 60 degrees, from left (pan=0) to right (pan=127).

b) pan_spread_angle=30, roll_angle=−180: panning in the horizontal plane along an arc of 60 degrees, from right (pan=0) to left (pan=127).

c) pan_spread_angle=−180, roll_angle=−180: panning in the horizontal plane all around the listener, starting in the rear (pan=0), going clockwise to the front (pan=64) and ending in the rear (pan=127).

d) pan_spread_angle=0: the legacy MIDI pan control has no effect and sounds are spatialized at the point defined by (azimuth_angle, elevation_angle, distance)

In order to implement such a feature, one can consider the following strategies for the cases where the pan controller is used along with a non-zero pan_spread_angle:

1. each individual note is positioned in 3D along the arc, as specified by the combination of the 3D MIDI controllers and its pan controller value.

2. the MIDI content is rendered as a 2-channel audio signal, each channel of which is virtualized at the extremities of the panning arc.

The first strategy above is a preferred embodiment. The first strategy will do a better job at delivering a continuous panning along the arc, which is not the case in the second strategy for large values of the pan_spread_angle. In example c), strategy 2) would spatialize all sounds in the rear, while the first solution would create a wrap-around effect.

The scope of the invention is not so limited but is intended to extend, without limitation, to other methods of implementing and rendering the notes or events included in the input signal, including at least the following methods:

3. the MIDI content is rendered as an m-channel audio signal, where m>2, each channel of which is virtualized along the panning arc. This is an extrapolation of the second strategy, where the increase in the number of channels the MIDI content is rendered as will increase the spatial fidelity of final rendering, meaning it is easier for the listener to localize the sounds around him in the listening space. An example of this technique would be a 3-channel version where the MIDI content is rendered as a left (L), a center (C) and a right (R) channel. Each note whose Pan is in the [0, 64) interval would be reproduced by contributions of the L and C channels, and by the C and R channels for Pan values between (64, 127]. The L and R channels are then positioned in 3D at the extremities of the arc, and the C channel is positioned in the middle of the arc.

4. the MIDI content is rendered as a 2-channel audio signal, and is upmixed to 3 or more channels, each channel of which is virtualized along the panning arc. Like strategy 3, this strategy also increases the spatial fidelity over the second one, but here the spatial fidelity will be dependent on the upmix technology being used to derive the additional channels to be spatialized along the arc.

Figure 6A:
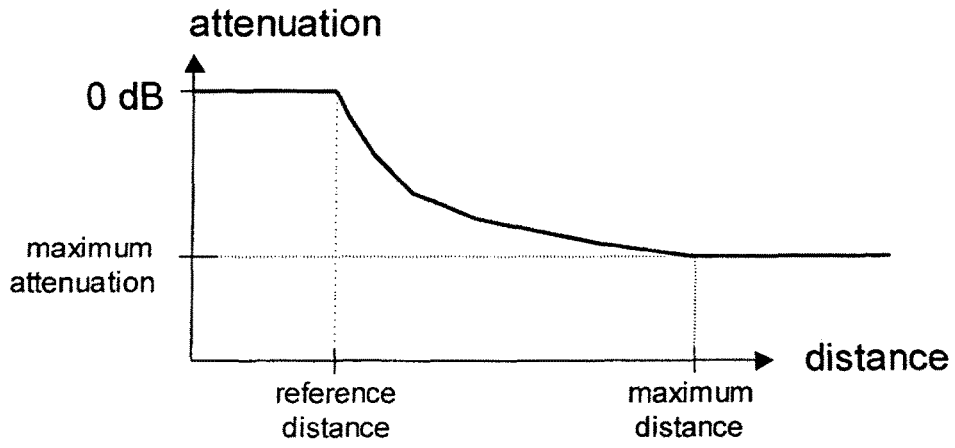
FIG. 6 is a diagram illustrating the attenuation distance relationship using the extended 3D parameters in accordance with one embodiment of the present invention.
Figure 6B:
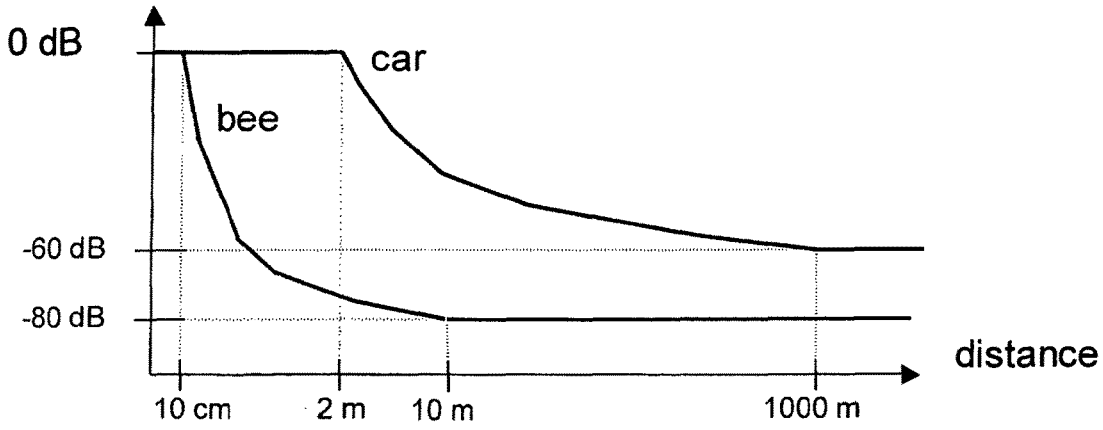

Distance-Based Attenuation: (See FIGS. 6A-6B)

This section describes an attenuation model based on the distance between the origin of the spherical coordinate system (the listening position), and the point in space associated with the MIDI channel. As shown in the figure below representing the attenuation according to the distance, this model relies on the following 3 parameters:

1. max_distance: the distance at which no additional distance based attenuation is applied when the sound moves further away 2. reference_distance: the distance beyond which distance based attenuation is applied, and below which no distance based attenuation is applied 3. max_attenuation: the maximum distance based attenuation applied to the sound. It is applied when the sound is at max_distance.

The attenuation curve applied when the distance is between reference_distance and max_distance is defined in this proposal by the model chosen by the IA-SIG for the 3D Audio Rendering and Evaluation guidelines Level 2 (I3DL2). It defines an attenuation in dB given by the following formula:

$$\text{attenuation} = 20\log_{10}\left(\frac{\text{reference_distance}}{\text{reference_distance} + ROF \cdot (\text{distance} - \text{reference_distance})}\right)$$

where ROF, the roll off Factor, is a scaling factor that is used to scale the distances beyond the reference distance. This model is also used in OpenAL and Microsoft's DirectSound3D, and is therefore implemented by PC soundcard manufacturers in their implementation of the OpenAL or DirectSound APIs.

With this attenuation curve, a value of 1.0 for the roll off factor (which is the default value in DirectSound) leads for instance to an attenuation of 60 dB when a sound, whose reference distance is 1 meter, is 1000 meters away. This also results in an attenuation of 6 dB for each doubling of the distance. In order to use this attenuation model given the parameters of the proposed model, one would simply need to use a roll off factor given by:

$$ROF = \frac{\text{reference_distance} \cdot 10^{-\frac{max_attenuation}{20}} - \text{reference_distance}}{\text{max_distance} - \text{reference_distance}}$$

Note that the computation of a roll off factor is only valid when max_distance and reference_distance are not equal. When they are, there is no attenuation in the [0, reference_distance] range (=[0, max_distance]), and the attenuation jumps to max_attenuation in the] reference_distance, +∞[range (==] max_distance, +∞[)

Based on this distance attenuation model, 3D MIDI uses a set of four parameters to encode the description of the attenuation characteristics of a MIDI channel, along with the distance it is to be rendered at. The parameters are the following:

1. maximum_distance
2. gain_at_maximum_distance
3. distance_ratio
4. reference_distance_ratio The first parameter, maximum_distance, is expressed in units of distance (can be meters) and defines the point where an attenuation of gain_at_maximum_distance is applied. In order to provide guaranteed precision for the range of distance in which distance based attenuation is applied, the distance of the source is expressed by the distance_ratio parameter as a ratio (between 0 and 1) of the maximum_distance parameter. Therefore the actual distance value (as used in the preceding example formulas) is defined by:

distance=distance_ratio*maximum_distance

The same principle applies to reference_distance_ratio, where the actual reference distance is defined by:

reference distance=reference_distance_ratio*maximum_distance

Here are examples for values of those parameters:

The buzz of a fly would typically not be heard beyond 10 meters away (maximum_distance=10, gain_at_maximum_distance=−163.83) but would sound significantly louder a few centimeters away from your ear (reference_distance_ratio=0.01, which means that between 0 and 10 cm, the fly sound is not attenuated). Here, given the maximum_distance, each step to express the distance of the fly with the distance_ratio parameter is about 0.6 millimeters.

The engine of a car will be barely heard a kilometer away (maximum_distance=1000, gain_at_maximum_distance=−80) and could be recorded about one meter away (reference_distance_ratio=0.001). Here the distance_ratio offers a step of 6 centimeters.

As a reference for the reader, here is another attenuation scheme found in the literature:

$$\text{attenuation} = 20\log_{10}\left(\frac{\text{reference_distance}}{\text{distance}}\right)^{\alpha}$$

A default value of 1 for alpha causes the sound to drop by 6 dB per doubling of the distance, which is what is to expect for the simulation of a punctual sound source. With an alpha of ½, the attenuation is 3 dB per doubling of the distance, which fits the model of a lineic sound source (such as a river or the waves on the beach).

One can deduct the value of alpha given the parameters of the proposed model with:

If the need arises, it can be envisioned that future extensions of 3D MIDI could support multiple distance based attenuation models, whose selection would be triggered by the MIDI content, but the default behavior would be the one defined herein.

The description accurately describes appropriate mathematical equations used for computing properties of the controllers result on lower level parameters such as "gain". The description also contains some suggested minimum-quality results of synthesizers rendering content in 3D based on control data in the format defined herein.

Figure 4:
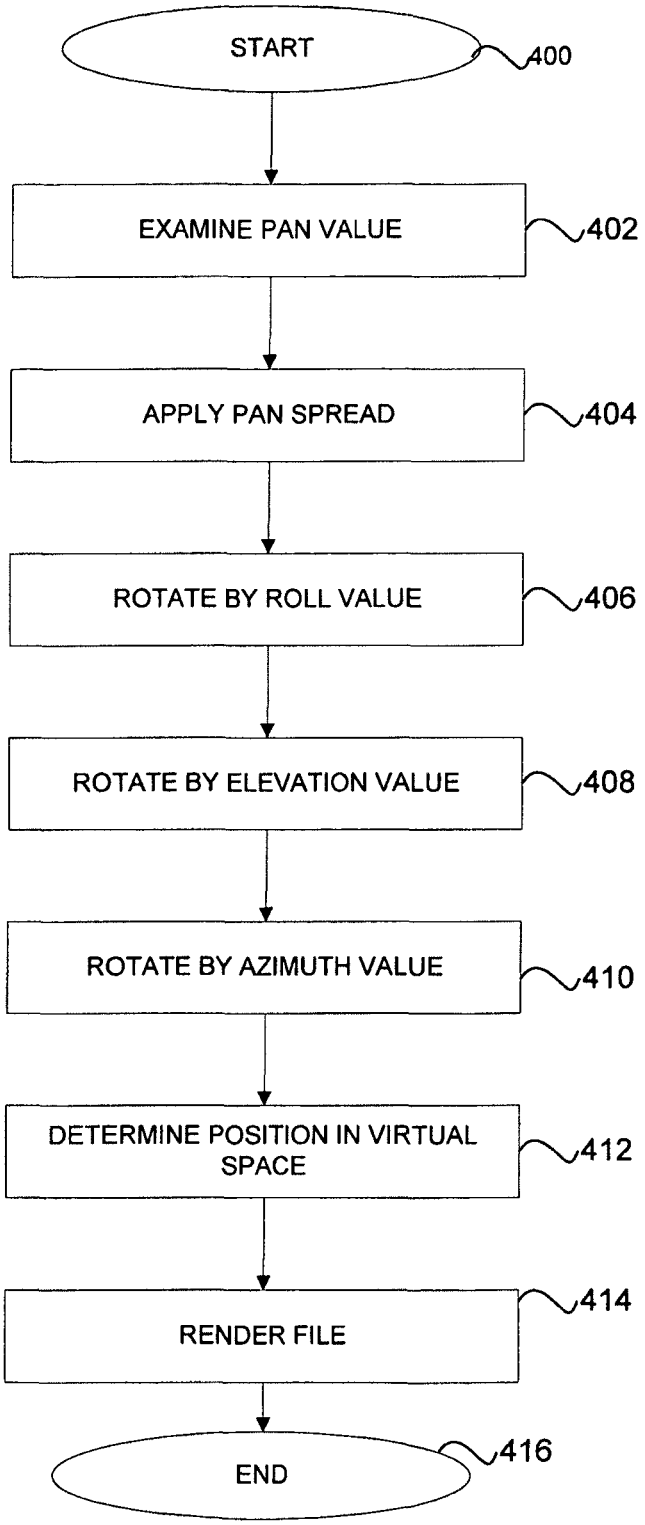
FIG. 4 is a flowchart illustrating steps involved in adding extensions to a legacy MIDI signal in accordance with one embodiment of the present invention.

FIG. 4 is a flowchart illustrating steps involved in adding extensions to a legacy MIDI signal in accordance with one embodiment of the present invention. The method starts at step 400. Next, the pan value for the MIDI message is examined in step 402. This is used in conjunction with an applied pan spread value in step 404 to determine the spread of the stereo streams and an initial location of the source within that spread. If no pan spread value is provided, the default value for the spread is used. Next in sequence, rotation by the roll value 406, rotation by the elevation value 408, and rotation by the azimuth value 410 occur. As a result, the position of the source in virtual space is determined (412). Next, the note or file is rendered in step 414 and the process ends at step 416.

The foregoing description describes several embodiments of an extended MIDI specification. That is, an extended format for providing music messages is described.

The scope of the invention is also intended to extend to user interface devices capable of converting from a conventional music message system such as legacy MIDI to an extended system, such as 3D MIDI. By configuring a user interface in accordance with the embodiments described, a simplified navigation experience may be provided to upmix conventional content while preserving the capabilities of playback of the 3D message format on conventional 2D playback systems.

3D MIDI User Interface Console

The Musical Instrument Digital Interface (MIDI) is a protocol and set of commands for storing and transmitting information about music. MIDI output devices interpret this information and use it to synthesize music.

With the proliferation of multi-channel systems for home cinema, video games and music, the need for multi-channel production systems is growing. With these modern advances, the advancement of the MIDI standard from simple stereo rendering to true 3D sound rendering becomes the next logical step in MIDI evolution.

The following guidelines are provided to describe a non-limiting example of a user interface for use in providing control over all sound from an audio rendering device, or sound card. In accordance with one embodiment, the 3D MIDI category lists all the channels of the sound card's MIDI synthesizers. For example, in one embodiment, there will be 32 strips, each strip showing one channel. The first 16 strips will belong to the first of the sound card's MIDI synthesizer (Synth A), followed by 16 strips that will belong to the second of the sound card's MIDI synthesizers (Synth B). This category is preferably user interface for the embodiment of the 3D MIDI converter, as depicted in FIG. 1 104.

The example user interface allows a user to enhance the 3D sound emitted by the rendering music synthesizer that is rendering music according to a standard MIDI signal, without said user needing to change or manipulate the MIDI signal. Thus, a user who is not sufficiently technically adept to understand the MIDI signal format and semantics may still produce 3D sound using the more intuitive controls provided by the User Interface.

1.1.1 Strip Name

Figure 7A:
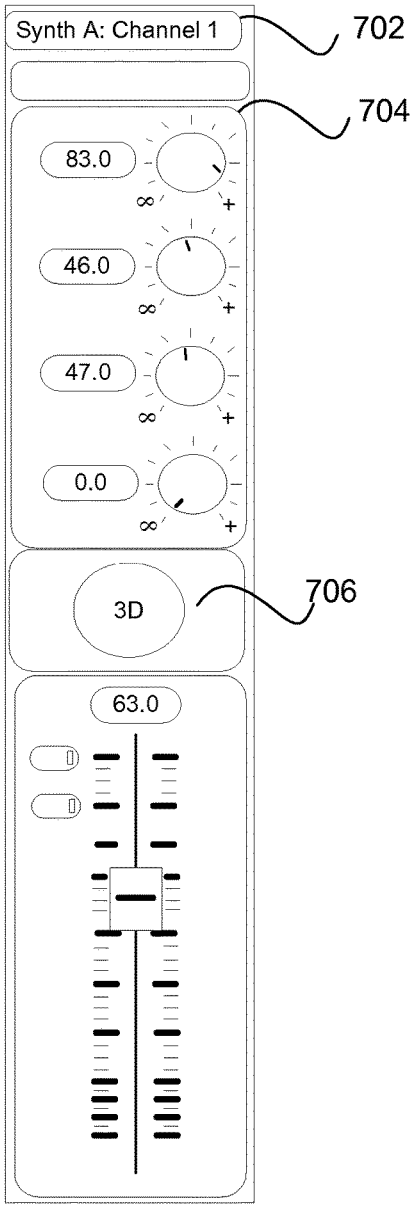
FIG. 7 is a diagram illustrating a user interface in accordance with one embodiment of the present invention.

As shown in FIG. 7A, the Strip Name label (702) Displays the midi synth and channel number.

1.1.2 Strip Positioning

Figure 7B:
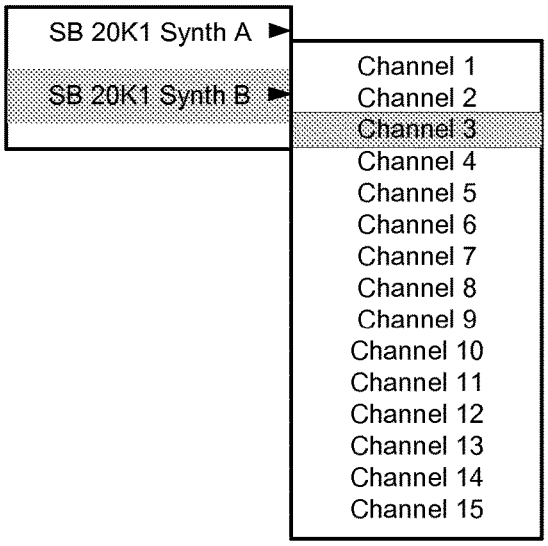

Right-clicking on any part of the strip will pop a 2 level popup menu. See FIG. 7B. The user can select a new source to place at the strip position.

A successful selection will swap the 2 strips.

1.1.3 Auxiliary Effects 1-4

This displays a set of four auxiliary effects applied across all strips shown.

1.1.4 3D Pan

Figure 7C:
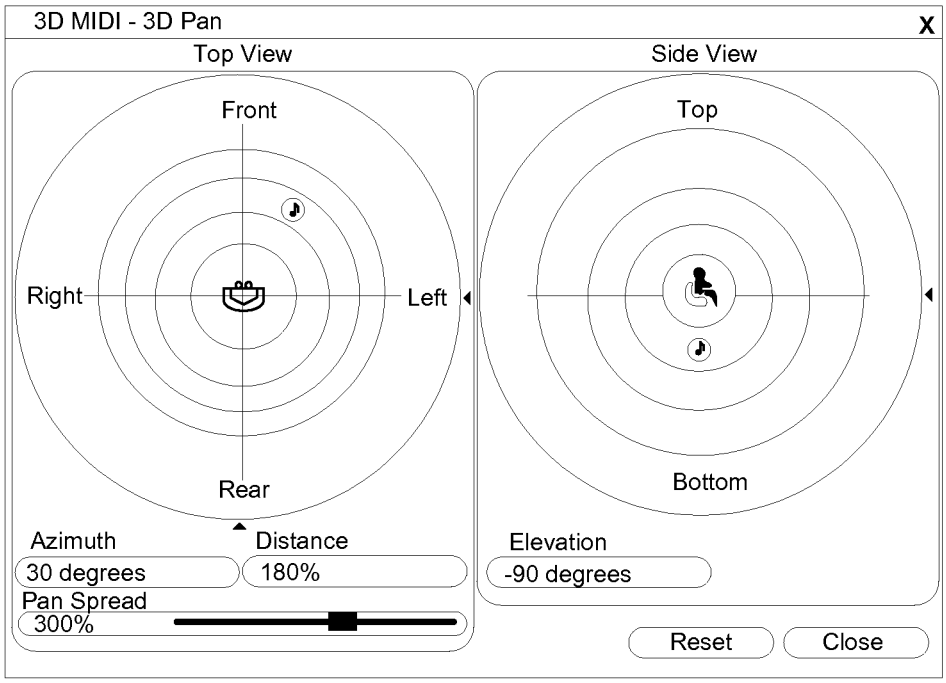

Supports a control to shift the sound position around the listener in two planes. When the user clicks on the 3D Pan area 706, a bigger window will pop up (See FIG. 7C), showing a top and side views with a control for sound positioning.

A user can drag the midi source within the area.

The following controls are provided on the interface to manipulate the corresponding UI 3D MIDI parameters. Preferred ranges are shown, but are not intended to be limiting.

Azimuth is the angle of the midi source from the center on the horizontal plane. Ranging from −180 to 180 with 0 degrees in front.

Distance is the displacement of the midi source from the center on the horizontal plane. Ranging from 0% to 400% where 100% is the distance of the speakers to the listener.

Elevation is the angle of the midi source from horizontal plane. Ranging from −180 to 180 where 90 degrees is on top of the listener and −90 degrees is below the listener.

Pan Spread designates the width that the midi source will sound on the horizontal plane if it spans the full range of the standard MIDI Pan parameter. Ranging from 0 to 600% with 100% as the default. This parameter will preferably appear as an arc on the midi source when pan spread is changing and disappears after a predetermined time period when there is no activity.

Reset will center the midi source at the listener position.

1.1.5 Mute/Solo

The mute control will mute the selected MIDI channel. The solo control will unmute the selected channel and mutes all the rest of the inputs that are not in solo mode. Muting a solo control will unsolo it. The last solo that is unmuted will also unmute all other sources.

1.1.6 Level/Volume

The volume control individually scales the dry-path volume according to the selected channel. The level will be displayed in dB.

Combining UI 3D MIDI Parameters with 3D MIDI Parameters

While the user interface as described above enables the user to manipulate the sound source along spherical polar coordinates, most 3D sound renderers in current use require the position to be expressed in Cartesian (i.e., x-y-z) coordinates. The following section describes how the 3D MIDI parameters are combined with the user interface 3D MIDI parameters, and with the legacy MIDI Pan controller, to compute a note position in space expressed in Cartesian coordinates. In a specific embodiment, a particular user interface, i.e., the Audio Creation Console UI, is described but not intended to limit the invention.

Input Parameters Include Global Parameters, User Interface Parameters, 3D MIDI Parameters, and Legacy Midi Parameters Input Parameters A. Global Parameters:

Global_PanSpreadFactor

In %, [100, 600], default=100

Note: this system wide value is preferably adjusted by the user by a physical rotary knob exposed on a breakout box. The minimum value of 100% (instead of 0%) is intended to prevent the user from involuntarily turning off the note panning.

B. User Interface (Audio Creation Console UI) Parameters

UI_Azimuth in degrees, [−180, 180], default=0

UI_Distance in %, [0, 400], default=100

UI_Elevation in degrees, [−180, 180], default=0

UI_PanSpreadFactor

In %, [0, 600], default=100

C. 3D MIDI Parameters

3D_Azimuth in degrees, [−180, 180[, default=0

3D_Elevation in degrees, [−180, 180[, default=0

3D_PanSpread in degrees, [−180, 180[, default=30

3D_PanRoll in degrees, [−180, 180[, default=0

3D_MaximumDistance

3D_GainAtMaxDistance

3D_RefDistance

3D_DistanceRatio

3D_Gain

D. Legacy MIDI Parameters

MIDI_Pan

Output Values

We list below the parameters needed for the 3D rendering of the 3D channel. They are the following:

Attenuation and Distance related parameters:

i. Final_MaximumDistance ii. Final_GainAtMaxDistance iii. Final_RefDistance
iv. Final_Distance
v. Final_Gain Position parameters (expressed in right-handed coordinate system, i.e. user facing −z):

i. Final_X
ii. Final_Y
iii. Final_Z

These attenuation and distance output values are computed in the following way:

Final_MaximumDistance=3D_MaximumDistance
Final_GainAtMaxDistance=3D_GainAtMaxDistance
Final_RefDistance=3D_RefDistance $$\text{Final_Distance} = \text{Final_MaximumDistance} * \left(\frac{\text{UI_Distance}}{100}\right) * \text{3D_DistanceRatio}$$

Final_Gain=3D_Gain

The note position in Cartesian coordinates is obtained by a series of rotations applied on an original starting position (0, 0, −1). The notation R(alpha, A) corresponds to a rotation of alpha degrees around the axis A.

compute the angle of the note on the horizontal plane:

note_angle=MIDI_Pan*3*D*_PanSpread_*(*UI*_PanSpreadFactor/100)*(Global_PanSpreadFactor/100)

if(note_angle<−180) then note_angle=−180
if(note_angle>180) then note_angle=180 use this angle to compute the (x, y, z) position ($P_1$) along the panning arc:

$P_1$=R(note_angle, Y). (0, 0, −1)

apply the roll on the panning arc:

$P_2$=R(3D_PanRoll, −Z). $P_1$ apply the elevation:

$P_3$=R(3D_Elevation, X). $P_2$ apply the azimuth:

$P_4$=R(3D_Azimuth, Y). $P_3$ apply the channel elevation based on the Audio Creation Console UI elevation value:

$P_5$=R(−UI_Elevation, X). $P_4$ apply the channel azimuth based on the Audio Creation Console UI azimuth value:

$P_6$=R(−UI_Azimuth, X). $P_5$

The final position $P_6$ is a normalized vector. The position of the note is $P_6$ multiplied by the distance:

FinalPosition=Final_Distance. $P_6$

Method and Apparatus for Enabling a User to Amend an Audio File

Further embodiments relate to a method and apparatus for enabling a user to amend an audio file, via a user interface for controlling a driver for re-authoring the audio file. Particularly, but not exclusively, this embodiment relates to a method and apparatus for enabling a user to amend a MIDI file, via a user interface for controlling a driver for applying three-dimensional audio data to the MIDI file. It may apply to legacy (standard) MIDI files as well as MIDI files already including 3D parameters.

Many individual users download and listen to music, in the form of MIDI files, on their own PC. However, users are becoming more sophisticated and are requiring improved soundscapes for MIDI files. In addition, users want to be able to personalise MIDI files for improved listening, for example by amending the MIDI file soundscape and saving their own changes.

In general terms, this embodiment proposes that a user interface be provided for controlling a driver for re-authoring an audio file. In that user interface, an icon is assigned to each instrument or set of instruments in the audio file. For each icon, a particular position (relative to the user) may be selected and/or a particular trajectory (relative to the user) may be selected. The particular trajectory may be selected from a selection of trajectories. The user interface shows the icons and the position of each icon relative to the user and may also show the trajectory assigned to each icon. Thus, the user is able to select a new position and/or a trajectory for an icon and, once he has done so, he can see the changes he has made on the user interface.

In particular, according to this embodiment, there is provided a method for enabling a user to amend an audio file, via a user interface for controlling a driver for re-authoring the audio file, the method comprising the steps of:

a) associating an icon on said user interface with one or more instruments or sets of instruments in said audio file;

b) providing a selection of possible trajectories for each said icon, each trajectory defining the virtual path, relative to said user, of the associated instrument or set of instruments;

c) providing a display on said user interface for showing the position of each said icon, each position defining the virtual position, relative to said user, of the associated instrument or set of instruments;

d) the user selecting an icon;

e) the user assigning a position and/or a trajectory from the selection, to the selected icon; and g) indicating, on said display, the position of the selected icon and whether a trajectory has been assigned to the selected icon.

Figure 8:
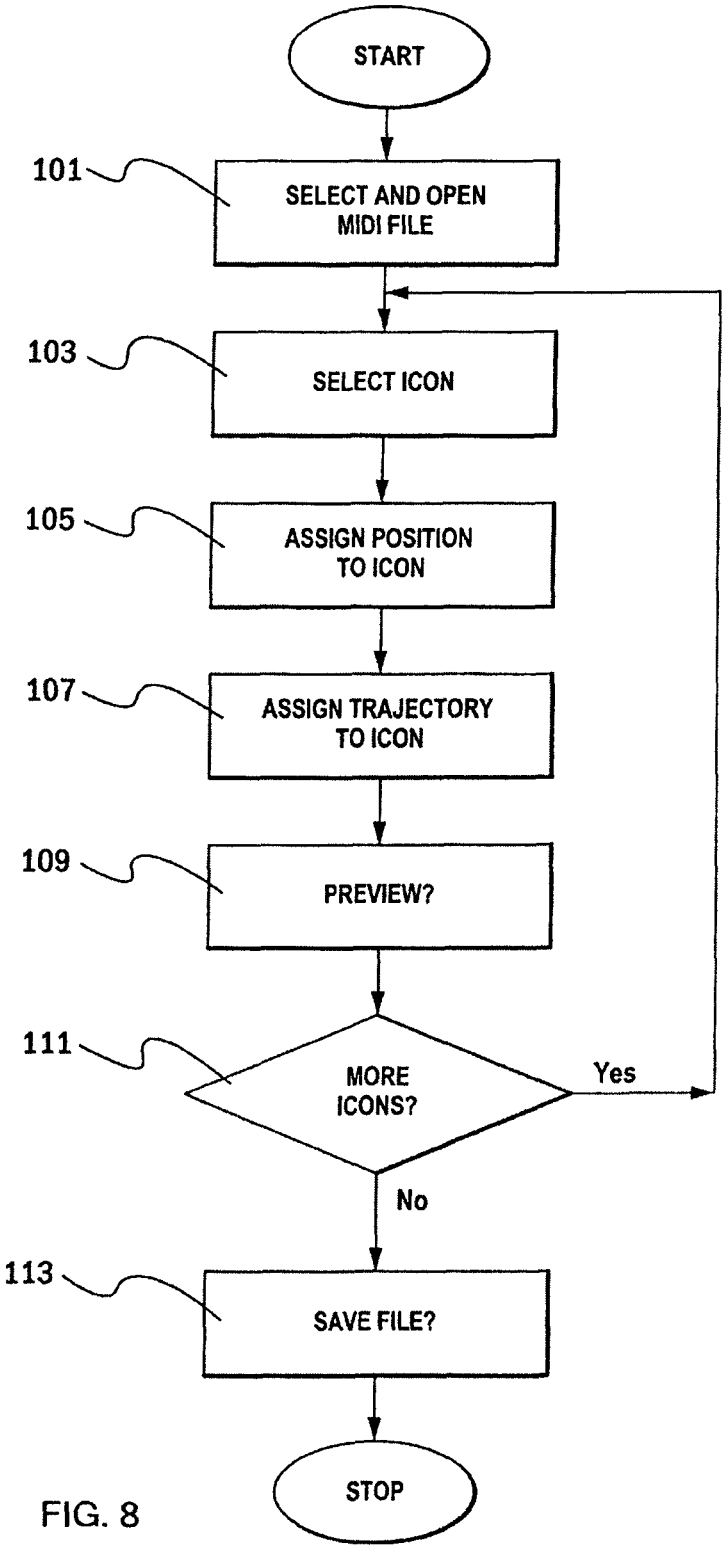
FIG. 8 is a flow diagram illustrating the steps in using a user interface to position events in a listening space in accordance with one embodiment of the present invention.

As illustrated in FIG. 8, the logic moves from a start step to step 101 where the user selects the particular MIDI file which is to be re-authored by the application of 3D audio rendering metadata. The file is typically an un-amended MIDI file with 2D audio only.

Once the user has opened the MIDI file, at step 101, he can immediately see a selection of icons representing the instruments within that file. Each icon may represent a single instrument (e.g. a keyboard/piano) or may represent more than one instrument (e.g. a keyboard plus a guitar) or may represent a set of instruments (e.g. the strings section of an orchestra). The number of icons will depend on the number of instruments which will, in turn, depend on the particular file selected.

The icons are displayed on the user interface in such a way as to show the position of each icon with respect to the user. The position of a particular icon on the display represents the virtual position relative to the user of the instrument or instruments associated with that icon i.e. the position relative to the user, from which the sound of the particular instrument or instruments associated with that icon will emanate, when the MIDI file is played.

It will be noted that "icon position" and "instrument position" will be used interchangeably in the specification but it should be understood that "icon position" refers to the position of the icon relative to the user on the user interface, whereas "instrument position" refers to the virtual position of the instrument relative to the user. The position of the icons/instruments may be restricted to a two dimensional horizontal plane around the user. Alternatively, the icons/instruments may be positioned in the three dimensional space around the user.

At step 103, the user selects a particular icon. The selected icon is one to which the user wants to assign a new position and/or trajectory i.e. the user wants the sound of the instrument or instruments associated with the selected icon to emanate from a new location when the MIDI file is played, or wants the sound of that instrument or instruments to emanate from a non-stationary location when the MIDI file is played.

At step 105, the user assigns a position to the selected icon. This may be by moving the selected icon to a different position on the user interface display.

At step 107, the user assigns a trajectory to the selected icon. The trajectory is selected from a list of possible trajectories for that icon. The possible trajectories may include trajectories within a two dimensional horizontal plane around the user (2D trajectories) and trajectories within the three dimensional space around the user (3D trajectories).

Once a trajectory has been assigned to a particular icon, the user interface shows which trajectory has been assigned to the icon. In addition, the appearance of the icon itself on the user interface changes. In this way, the user can immediately see which icons have been assigned trajectories and which have not i.e. which will move when the MIDI file is played and which will remain stationary.

It will be noted that "icon trajectory" and "instrument trajectory" will be used interchangeably in the specification but it should be understood that "icon trajectory" refers to the path of the icon relative to the user on the user interface, whereas "instrument trajectory" refers to the virtual path of the instrument relative to the user.

At step 109, the user has the option to play back the MIDI file to preview the soundscape with the new changes made at steps 103, 105 and 107.

Next, the logic moves to a decision block 111 where the user has the option to work with further icons. Thus, the user may assign new positions and trajectories to several or all the instruments within the file, previewing the effect each time by playing back the MIDI file. Once the user is satisfied that sufficient icons have been assigned a new position or trajectory, and the user is happy with the effect of those new positions/trajectories, the logic moves to step 113.

At step 113, the user has the option to save the file incorporating the changes he has made. Then the logic proceeds to a stop block.

Figure 9:
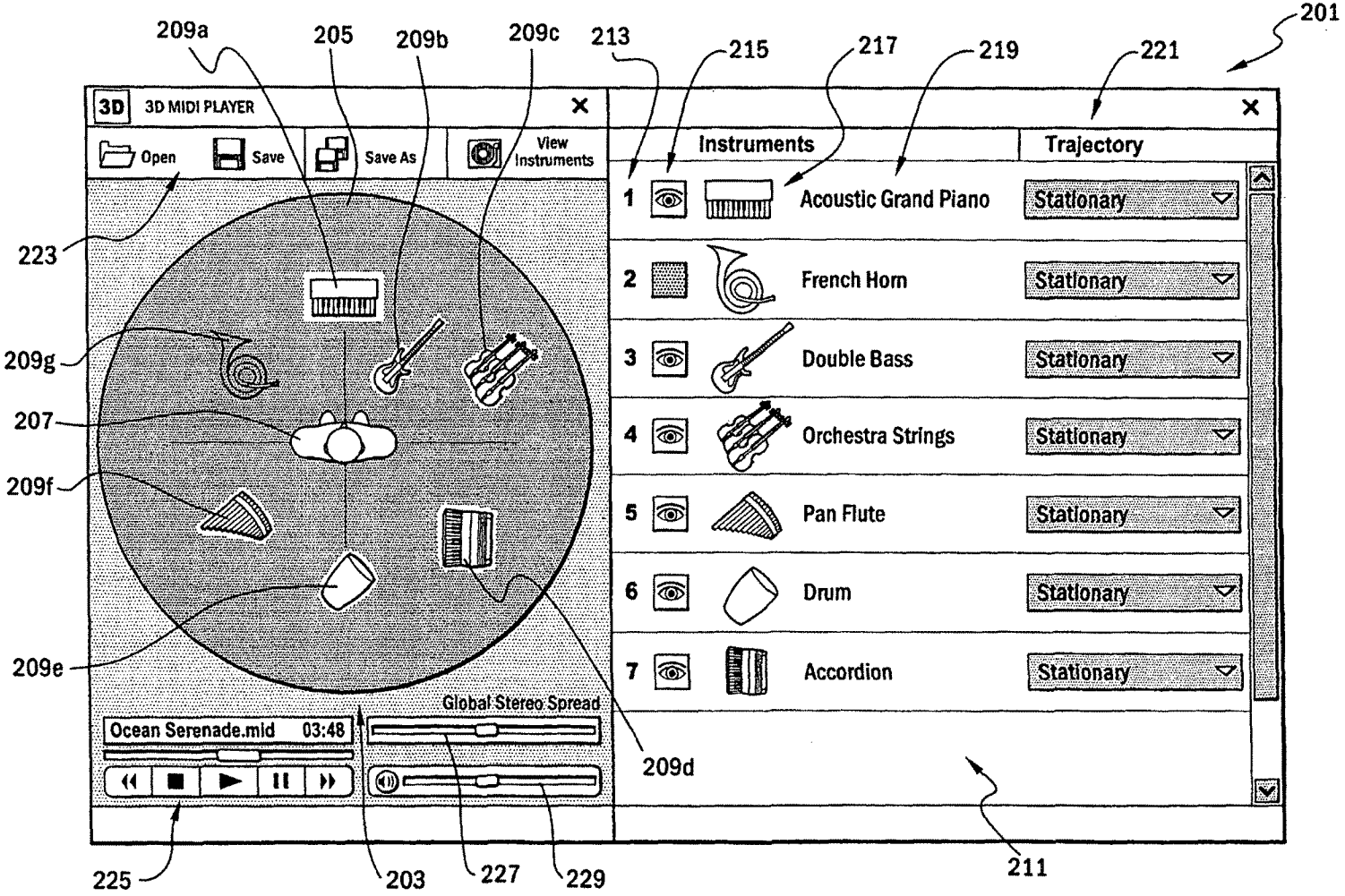
FIG. 9 is an exemplary user interface display in accordance with one embodiment of the present invention.

FIG. 9 shows an exemplary user interface display 201 for MIDI file "Ocean Serenade" as it might appear when the MIDI file is opened (step 101 in FIG. 11). On the left-hand side of the user interface display 201 is a user representation 203. The user representation 203 is a virtual plan view of the user and shows a circular horizontal plane 205 surrounding the user 207 at the center. Seven icons 209*a* to 209*g* are shown surrounding the user (although it will, of course, be understood that any number of icons may be shown and this will depend on the particular MIDI file). The angular position of each icon represents the position from which the sound of that instrument or instruments will emanate when the MIDI file is played. The radial position of each icon (i.e. the distance from the user 207) represents the volume of that instrument or instruments (relative to the other instruments) when the MIDI file is played.

On the right-hand side of the user interface display 201 is an instruments pane 211.

Five columns are shown on the instruments pane 211. The first column 213 shows the icon number. The second column 215 shows the visibility checkboxes. The third column 217 shows the icons themselves. The fourth column 219 shows the instrument(s) that each icon represents and the fifth column 221 shows whether a trajectory has been assigned to that instrument.

The first column 213 simply shows the icon number. A number is assigned to each icon to simplify identification of the icon for the user.

The second column 215 shows the visibility check boxes. If the checkbox next to a particular icon is checked, an eye image appears in the checkbox. The eye indicates that the icon is clearly visible in the user representation 203. If the eye is unchecked, that icon becomes faint in the user representation 203. This is useful if there are many instruments in the MIDI file and, consequently, many icons in the user representation 203. The user may only be interested in some of those icons and can de-select the eye checkbox on the remaining icons to produce a less cluttered view on the user interface. In FIG. 9, we see that icons 209*a* to 209*f* are clearly visible (the eye checkbox is selected) and icon 209*g* is faint (the eye checkbox is de-selected).

The third column 217 simply shows the icons themselves as they appear in the user representation.

The fourth column 219 shows the instrument(s) that each icon represents. We see that icon 209*a* represents an acoustic grand piano, 209*b* represents a French horn, 209*c* represents a double bass, 209*d* represents an orchestra strings section, 209*e* represents a pan flute, 209*f* represents a drum and 209*g* represents an accordion.

The fifth column 221 shows whether a trajectory has been assigned to that icon. In FIG. 12, we see that all the icons 209*a* to 209*g* are "stationary" i.e. no trajectories have been assigned.

Other features on the user interface include a toolbar 223 including Open, Save, Save As and View Instruments buttons, a Progress Bar 225, a Global Stereo Spread Indicator 227 and a Volume Indicator 229.

Toolbar 223 allows a user to open a MIDI file (Open button), to save the opened MIDI file (Save button) or to save the opened MIDI file as a new file (Save As button). The View Instruments button on toolbar 223 opens and closes the instruments pane 211.

The Progress Bar 225 shows progress when the MIDI file is being played back. The Progress Bar also includes play, stop, forward and rewind buttons.

The Global Stereo Spread Indicator 227 controls the stereo spread of the MIDI file playback and the Volume Indicator 229 controls the master volume.

Once the user is happy with the MIDI file, he may use the "Save" or "Save As" option in the tool bar 223 to save the MIDI file. Once the MIDI file has been saved, using the Save or Save As button, the new trajectories/positions assigned to various icons are associated with that MIDI file. Therefore, when the MIDI file is next played back, the various changes that have been made, will be incorporated. The MIDI file may be next played back by the same user or may be next played back by another use who may be remote from the first user. For example, the first user may electronically send the new MIDI file to the second user. Thus, other users will be able to experience the new MIDI file soundscape.

It will be understood that the steps of FIG. 8 may vary in other embodiments. For example, the user may wish to save the changes to the MIDI file as he works on it, or he may wish to preview the soundscape (listening space) or more regularly, or he may make changes to the files or input signals in real time.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method performed by a processor of upmixing a 2D MIDI signal, the method comprising:

receiving the 2D MIDI signal having a first set of parameters, wherein at least one of the first set of parameters defines a sound source position along a predefined arc in a 2D presentation space;

deriving a second set of parameters from the 2D MIDI signal by remapping the first set of parameters to the second set of parameters, wherein at least one parameter of the second set of parameters defines a sound source position in a 3D presentation space, wherein at least one parameter of the second set of parameters is a remapped function of a Pan parameter defining a virtual source position along the predefined arc as provided by at least one of the first set of parameters and a Pan Spread parameter defining distance between the endpoint positions of the predefined arc; and generating a 3D MIDI signal having the second set of parameters associated with it.

2. The method as recited in claim 1, wherein the first set of parameters comprises at least one of the following 2D MIDI parameters: Modulation, Breath, Volume, Balance, Expression, and Pitch Bend, and wherein the second set of parameters comprises at least one of the following 3D MIDI parameters: Elevation, Distance Ratio, Maximum Distance, Gain At Maximum Distance, Pan Spread, and Roll.

3. A method performed by a processor of positioning events in a presentation space, the method comprising:

receiving an input stream of events with at least one event having virtual location information defining a position of a predefined arc within the presentation space, the at least one event having separate pan information defining a virtual source position along the predefined arc; and assigning an output position in the presentation space for the at least one event based on a combination of the position of the predefined arc, the pan information and a separate second parameter, wherein the at least one event has a separate pan spread parameter defining distance between the endpoint positions of the predefined arc and wherein the separate second parameter is the separate pan spread parameter.

4. The method as recited in claim 3 wherein the input stream describes audio information, and the presentation space is a listening space.

5. The method as recited in claim 3 wherein the input stream is a MIDI signal.

6. The method as recited in claim 5 wherein the at least one event is a MIDI note.

7. The method as recited in claim 4 where the at least one event is an audio event.

8. The method as recited in claim 7 further comprising reproducing the audio event at the output position in the listening space.

9. The method as recited in claim 8 wherein reproducing the audio event comprises generating an audio signal to feed headphones.

10. The method as recited in claim 8 wherein reproducing the audio event comprises generating an audio signal to feed a reproduction system comprising 2 or more loudspeakers.

11. The method as recited in claim 3 wherein the separate pan spread parameter is used to affect a wrap-around effect of the events in the presentation space.

12. The method as recited in claim 3 wherein the separate pan spread parameter is controlled by a user on a user interface device.

13. The method as recited in claim 1, wherein the MIDI signal is associated with an audio stream.

14. A system for positioning events in a presentation space, the system comprising:

memory; and a processor operable to:

receive an input stream of events with at least one event having virtual location information defining a position of a predefined arc within the presentation space, the at least one event having separate pan information defining a virtual source position along the predefined arc; and assign an output position in the presentation space for the at least one event based on a combination of the position of the predefined arc, the pan information and a separate second parameter, wherein the at least one event has a separate pan spread parameter defining distance between the endpoint positions of the predefined arc and wherein the separate second parameter is the separate pan spread parameter.

15. The system as recited in claim 14 wherein the input stream describes audio information, and the presentation space is a listening space.

16. The system as recited in claim 14 wherein the input stream is a MIDI signal.

17. A computer program product for positioning events in a presentation space, the computer program product being embodied in a non-transitory computer readable medium and comprising computer executable instructions for:

receiving an input stream of events with at least one event having virtual location information defining a position of a predefined arc within the presentation space, the at least one event having separate pan information defining a virtual source position along the predefined arc; and assigning an output position in the presentation space for the at least one event based on a combination of the position of the predefined arc, the pan information and a separate second parameter, wherein the at least one event has a separate pan spread parameter defining distance between the endpoint positions of the predefined arc and wherein the separate second parameter is the separate pan spread parameter.

18. The computer program product as recited in claim 17 wherein the input stream describes audio information, and the presentation space is a listening space.

19. The computer program product as recited in claim 17 wherein the input stream is a MIDI signal.

20. The method as recited in claim 1, wherein the 2D MIDI signal having the first set of parameters is readable on 2D MIDI playback systems, and wherein the 3D MIDI signal having the second set of parameters is readable on 2D MIDI playback systems and also on 3D MIDI playback systems.

* * * * *